US010280593B2

(12) United States Patent
Hijikata et al.

(10) Patent No.: US 10,280,593 B2
(45) Date of Patent: May 7, 2019

(54) HYDRAULIC FLUID ENERGY REGENERATION DEVICE FOR WORK MACHINE

(71) Applicant: Hitachi Construction Machinery Co., Ltd., Taito-ku, Tokyo (JP)

(72) Inventors: Seiji Hijikata, Tuskuba (JP); Kouji Ishikawa, Kasumigaura (JP); Takatoshi Ooki, Kasumigaura (JP); Shinya Imura, Toride (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 221 days.

(21) Appl. No.: 15/120,545

(22) PCT Filed: May 16, 2014

(86) PCT No.: PCT/JP2014/063121
§ 371 (c)(1),
(2) Date: Aug. 22, 2016

(87) PCT Pub. No.: WO2015/173963
PCT Pub. Date: Nov. 19, 2015

(65) Prior Publication Data

US 2017/0009428 A1 Jan. 12, 2017

(51) Int. Cl.
*F15B 21/14* (2006.01)
*E02F 9/22* (2006.01)
(Continued)

(52) U.S. Cl.
CPC ..... *E02F 9/2217* (2013.01); *E02F 9/2095* (2013.01); *E02F 9/2232* (2013.01);
(Continued)

(58) Field of Classification Search
CPC ..... E02F 9/2217; E02F 9/2095; E02F 9/2235; E02F 9/2242; E02F 9/2296; E02F 9/2292;
(Continued)

(56) References Cited

U.S. PATENT DOCUMENTS 9,416,799 B2 * 8/2016 Danzl ..... E02F 9/2217
9,897,119 B2 * 2/2018 Kawasaki ..... F15B 21/14
(Continued)

FOREIGN PATENT DOCUMENTS

JP 2000-136806 A 5/2000
JP 2004-116603 A 4/2004
(Continued)

OTHER PUBLICATIONS

International Search Report (PCT/ISA/210) issued in PCT Application No. PCT/JP2014/063121 dated Jul. 22, 2014, with English translation (six (6) pages).
(Continued)

*Primary Examiner* — Abiy Teka
(74) *Attorney, Agent, or Firm* — Crowell & Moring LLP

(57) ABSTRACT

Provided is a hydraulic fluid energy regeneration device for a work machine, including: a regeneration hydraulic motor driven by discharged return hydraulic fluid; a first hydraulic pump mechanically connected to the regeneration hydraulic motor; a second hydraulic pump that delivers an hydraulic fluid for driving a first hydraulic actuator and/or a second hydraulic actuator; a junction line that allows the hydraulic fluid delivered by the second hydraulic pump to be joined; a second regulator that regulates the delivery flow rate of the second hydraulic pump; and a first regulator that regulates the flow rate of the hydraulic fluid coming from the first hydraulic pump and flowing through the junction line. A control unit includes: a first computing part that calculates a demanded pump flow rate in accordance with the input
(Continued)

target replacement command for the second hydraulic pump, the first computing part further outputting a control command to the first regulator in such a manner that the flow rate of the hydraulic fluid coming from the first hydraulic pump and flowing through the junction line equals to or lower than the demanded pump flow rate; and a second computing part that subtracts from the demanded pump flow rate the flow rate of the hydraulic fluid coming from the first hydraulic pump to obtain a target pump flow rate, the second computing part further outputting a control command to the second regulator in such a manner that the calculated target pump flow rate is attained.

9 Claims, 10 Drawing Sheets

(51) Int. Cl.

| | |
|---|---|
| ***F15B 11/16*** | (2006.01) |
| ***F15B 13/06*** | (2006.01) |
| ***F15B 21/08*** | (2006.01) |
| ***E02F 9/20*** | (2006.01) |
| ***F04B 49/00*** | (2006.01) |
| *E02F 3/32* | (2006.01) |

(52) U.S. Cl.
CPC ..... *E02F 9/2235* (2013.01); *E02F 9/2242* (2013.01); *E02F 9/2292* (2013.01); *E02F 9/2296* (2013.01); *F04B 49/00* (2013.01); *F15B 11/16* (2013.01); *F15B 13/06* (2013.01); *F15B 21/087* (2013.01); *F15B 21/14* (2013.01); *E02F 3/32* (2013.01); *F15B 2211/20515* (2013.01); *F15B 2211/20523* (2013.01); *F15B 2211/20546* (2013.01); *F15B 2211/20576* (2013.01); *F15B 2211/255* (2013.01); *F15B 2211/61* (2013.01); *F15B 2211/6309* (2013.01); *F15B 2211/6313* (2013.01); *F15B 2211/6316* (2013.01); *F15B 2211/6652* (2013.01); *F15B 2211/6654* (2013.01)

(58) Field of Classification Search
CPC ..... E02F 9/2232; F04B 49/00; F15B 21/087; F15B 13/06; F15B 11/16; F15B 21/14
See application file for complete search history.

(56) References Cited

U.S. PATENT DOCUMENTS

| | | | | |
|---|---|---|---|---|
| 2012/0245782 | A1 | 9/2012 | Kawasaki et al. | |
| 2014/0245729 | A1* | 9/2014 | Nanjo ..... | E02F 9/226 60/414 |

FOREIGN PATENT DOCUMENTS

| | | | |
|---|---|---|---|
| JP | 2004-116656 | A | 4/2004 |
| JP | 2011-202457 | A | 10/2011 |
| JP | 2014-25498 | A | 2/2014 |
| JP | 2014-37861 | A | 2/2014 |

OTHER PUBLICATIONS

International Preliminary Report on Patentability (PCT/IB/338 & PCT/IB/373) including English translation of Written Opinion (PCT/ISA/237) issued in PCT Application No. PCT/JP2014/063121 dated Dec. 1, 2016 (seven pages).

* cited by examiner

HYDRAULIC FLUID ENERGY REGENERATION DEVICE FOR WORK MACHINE

TECHNICAL FIELD

The present invention relates to a hydraulic fluid energy regeneration device for a work machine. More particularly, the invention relates to a hydraulic fluid energy regeneration device for a work machine such as a hydraulic excavator equipped with hydraulic actuators.

BACKGROUND ART

With a view to providing a work machine with a hydraulic fluid energy regeneration device and a hydraulic fluid energy recovery and regeneration device with space-saving dimensions and capable of enlarging the scope of recovered energy uses, there have been disclosed techniques involving a hydraulic pump motor driven by return hydraulic fluid from hydraulic actuators, an electric motor generating power when driven by the hydraulic pump motor, and a battery for storing the power generated by the electric motor (e.g., see Patent Document 1).

PRIOR ART DOCUMENTS

Patent Document

Patent Document 1: JP-2000-136806-A

SUMMARY OF INVENTION

Problem to be Solved by the Invention

The above-mentioned prior art has the advantage of requiring a smaller occupied space than if the energy of hydraulic fluid is stored typically in accumulators, because the hydraulic fluid energy is converted to electric energy for storage in the battery.

However, one problem with the prior art for the work machine is that converting the hydraulic fluid energy into electric energy for storage in the battery involves significant energy losses during recovery and reuse. The challenge is the hydraulic fluid energy being not efficiently utilized.

Specifically, when the energy of return hydraulic fluid from actuators is stored into the battery, energy losses occur in the hydraulic pump motor, in the electric motor, and in the battery during charging and discharging. What is stored into the battery is the recovered energy minus the sum of these losses. When the recovered energy stored in the battery is reused, further energy losses occur in the battery, in the electric motor, and in the hydraulic pump motor. With such energy losses during recovery through reuse taken into consideration, the work machine adopting the existing techniques can conceivably lose as much as half the recoverable and reusable energy.

The present invention has been made in view of the above circumstances and provides as an object a hydraulic fluid energy regeneration device for a work machine capable of efficiently utilizing the return hydraulic fluid from hydraulic actuators.

Means for Solving the Problem

In achieving the foregoing object of the present invention and according to a first embodiment thereof, there is provided a hydraulic fluid energy regeneration device for a work machine, including: a first hydraulic actuator; a regeneration hydraulic motor driven by return hydraulic fluid discharged by the first hydraulic actuator; a first hydraulic pump mechanically connected to the regeneration hydraulic motor; a second hydraulic pump that delivers the hydraulic fluid for driving the first hydraulic actuator and/or a second hydraulic actuator; a junction line that allows the hydraulic fluid delivered by the first hydraulic pump to join the hydraulic fluid delivered by the second hydraulic pump; a first regulator that regulates the flow rate of the hydraulic fluid coming from the first hydraulic pump and flowing through the junction line; a second regulator that regulates the delivery flow rate of the second hydraulic pump; and a control unit to which a target displacement command for the second hydraulic pump is input, the control unit calculating the flow rate of the hydraulic fluid delivered by the first hydraulic pump and the flow rate of the hydraulic fluid delivered by the second hydraulic pump in accordance with the target displacement command, the control unit further outputting a control command to the first regulator and a control command to the second regulator in accordance with the calculated flow rates. The control unit includes: a first computing part that calculates a demanded pump flow rate in accordance with the input target replacement command for the second hydraulic pump, the first computing part further outputting a control command to the first regulator in such a manner that the flow rate of the hydraulic fluid coming from the first hydraulic pump and flowing through the junction line equals to or lower than the demanded pump flow rate; and a second computing part that subtracts from the demanded pump flow rate the flow rate of the hydraulic fluid coming from the first hydraulic pump and flowing through the junction line to obtain a target pump flow rate, the second computing part further outputting a control command to the second regulator in such a manner that the calculated target pump flow rate is attained.

A second embodiment of the present invention is derived from the first embodiment above, further including: an electric motor mechanically connected to the first hydraulic pump and to the regeneration hydraulic motor; a third regulator that regulates the revolution speed of the electric motor; an operating device for operating the first hydraulic actuator; and an operation amount detector that detects an operation amount of the operating device. The control unit includes a third computing part that is configured to: receive the operation amount of the operating device detected by the operation amount detector; calculate, in accordance with the operation amount, recovered power to be input to the regeneration hydraulic motor from the return hydraulic fluid discharged by the first hydraulic actuator; calculate demanded assist power necessary for supplying the hydraulic fluid flow from the first hydraulic pump through the junction line; set target assist power in such a manner that the recovered power and the demanded assist power are not exceeded; and output control commands to the second regulator and the third regulator in such a manner that the target assist power is attained.

A third embodiment of the present invention is derived from the first embodiment above, further including: a discharge circuit that branches from a branch part attached to a line connecting the first hydraulic actuator with the regeneration hydraulic motor, the discharge circuit discharging the return hydraulic fluid from the first hydraulic actuator to a tank; a selector valve attached to the discharge circuit, the selector valve switching between communication and interruption of the discharge circuit; an operating device for operating the first hydraulic actuator; and an operation amount detector that detects an operation amount of the operating device. The control unit includes a fourth computing part that receives the operation amount of the operating device detected by the operation amount detector, the fourth computing part outputting an interruption command to the selector valve in accordance with the operation amount.

A fourth embodiment of the present invention is derived from the second embodiment above, further including: a discharge circuit that branches from a branch part attached to a line connecting the first hydraulic actuator with the regeneration hydraulic motor, the discharge circuit discharging the return hydraulic fluid from the first hydraulic actuator to a tank; and a flow rate regulating means attached to the discharge circuit, the flow rate regulating means regulating the flow rate of the discharge circuit. The control unit includes a fifth computing part that outputs a control command to the flow rate regulating means in such a manner as to let the power discharged by the first hydraulic actuator branch to the discharge circuit such that the recovered power does not exceed maximum power of the electric motor.

A fifth embodiment of the present invention is derived from the second embodiment above, further including: a discharge circuit that branches from a branch part attached to a line connecting the first hydraulic actuator with the regeneration hydraulic motor, the discharge circuit discharging the return hydraulic fluid from the first hydraulic actuator to a tank; and a flow rate regulating means attached to the discharge circuit, the flow rate regulating means regulating the flow rate of the discharge circuit. The control unit includes a sixth computing part that outputs a control command to the flow rate regulating means in such a manner as to let the power discharged by the first hydraulic actuator branch to the discharge circuit such that the recovered power does not exceed the sum of maximum power of the electric motor and the demanded assist power.

A sixth embodiment of the present invention is derived from the first embodiment above, further including: a branch part attached to a line connecting the first hydraulic actuator with the regeneration hydraulic motor; and a flow rate regulating means attached to the discharge circuit, the flow rate regulating means regulating the flow rate of the discharge circuit. The control unit includes a seventh computing part that outputs a control command to the flow rate regulating means in such a manner as to let the power discharged by the first hydraulic actuator branch to the discharge circuit such that a maximum hydraulic fluid flow allowed to be input to the regeneration hydraulic motor is not exceeded.

A seventh embodiment of the present invention is derived from the first embodiment above, further including: a discharge line that branches from the junction line and communicates with a tank; and a bleed valve attached to the discharge line, the bleed valve bleeding part or all of the hydraulic fluid from the first hydraulic pump off into a tank. The first regulator is a solenoid proportional valve regulating the opening area of the bleed valve.

An eighth embodiment of the present invention is derived from the first embodiment above, in which the first hydraulic pump is a variable displacement hydraulic pump; and in which the control unit controls the displacement of the variable displacement hydraulic pump.

A ninth embodiment of the present invention is derived from the first embodiment above, in which the second hydraulic pump is a variable displacement hydraulic pump; and in which the control unit controls the displacement of the variable displacement hydraulic pump.

Effect of the Invention

According to the present invention, a hydraulic pump mechanically connected to a regenerative hydraulic motor is directly driven by recovered energy. This eliminates energy losses incurred during temporary energy storage. With losses in energy conversion reduced, recovered energy is utilized efficiently.

MODES FOR CARRYING OUT THE INVENTION

Described below with reference to the accompanying drawings is a hydraulic fluid energy regeneration device for a work machine practiced as embodiments of the present invention.

First Embodiment

Figure 1:
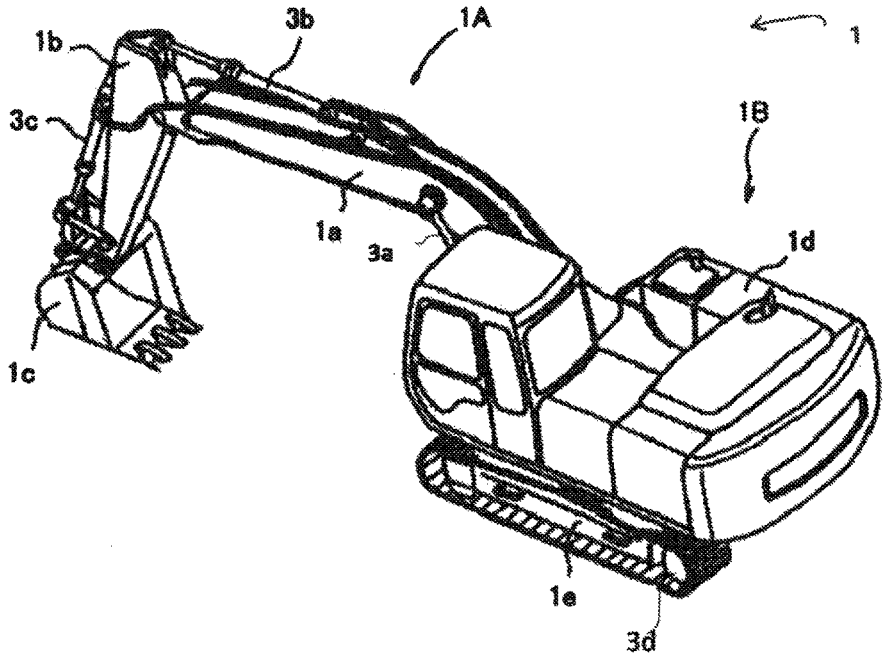
FIG. 1 is a perspective view of a hydraulic excavator equipped with a hydraulic fluid energy regeneration device for a work machine, the hydraulic fluid energy regeneration device being practiced as a first embodiment of the present invention.
Figure 2:
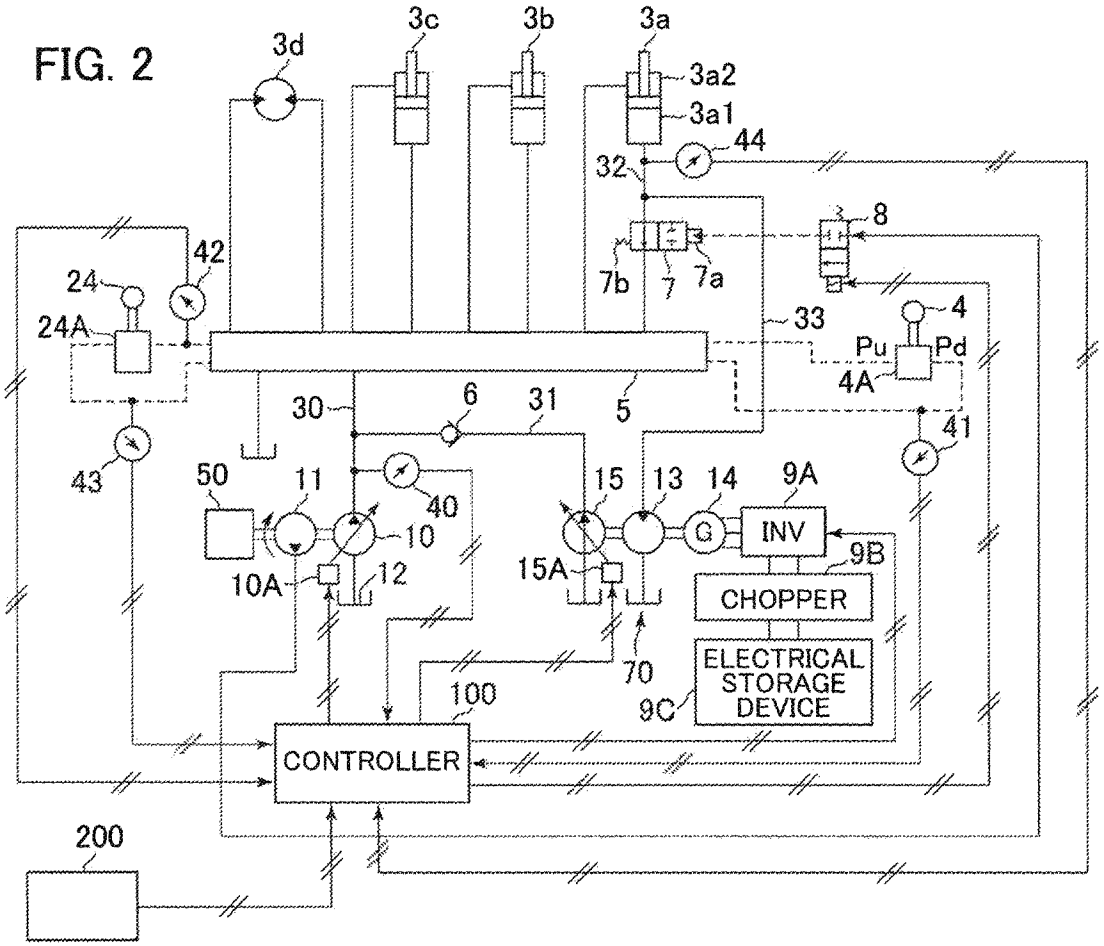
FIG. 2 is a schematic view of a drive control system constituting part of the hydraulic fluid energy regeneration device for a work machine, the hydraulic fluid energy regeneration device being practiced as the first embodiment.

FIG. 1 is a perspective view of a hydraulic excavator equipped with a hydraulic fluid energy regeneration device for a work machine, the hydraulic fluid energy regeneration device being practiced as a first embodiment of the present invention, and FIG. 2 is a schematic view of a drive control system constituting part of the hydraulic fluid energy regeneration device for a work machine, the hydraulic fluid energy regeneration device being practiced as the first embodiment.

In FIG. 1, a hydraulic excavator 1 has an articulated work device 1A equipped with a boom 1*a*, an arm 1*b*, and a bucket 1*c*; and a vehicle body 1B furnished with an upper swing structure 1*d* and a lower track structure 1*e*. The boom 1*a* is rotatably supported by the upper swing structure 1*d* and driven by a boom cylinder (hydraulic cylinder) 3*a* that is a first hydraulic actuator. The upper swing structure 1*d* is rotatably mounted on the lower track structure 1*e*.

The arm 1*b* is rotatably supported by the boom 1*a* and is driven by an arm cylinder (hydraulic cylinder) 3*b*. The bucket 1*c* is rotatably supported by the arm 1*b* and driven by a bucket cylinder (hydraulic cylinder) 3*c*. The lower track structure 1*e* is driven by left and right traveling motors 3*d* and 3*e*. The drive of the boom cylinder 3*a*, arm cylinder 3*b*, and bucket cylinder 3*c* is controlled by operating devices 4 and 24 (see FIG. 2). The operating devices 4 and 24 are installed in a cab of the upper swing structure 1*d*, and they output hydraulic signals.

The drive control system shown in FIG. 2 has a power regeneration device 70, the operating devices 4 and 24, a control valve 5 including a plurality of spool type directional control valves, a check valve 6, a solenoid selector valve 7, a selector valve 8, an inverter 9A acting as a third adjustor, a chopper 9B, an electrical storage device 9C, and a controller 100 acting as a control unit.

As a hydraulic power source device, there are provided a variable displacement hydraulic pump 10 acting as a second hydraulic pump, a pilot hydraulic pump 11 that supplies pilot hydraulic fluid, and a tank 12. The hydraulic pump 10 and the pilot hydraulic pump 11 are driven by an engine 50 connected by a drive shaft. The hydraulic pump 10 has a regulator 10A acting as a second adjustor. The regulator 10A regulates the delivery flow rate of the hydraulic pump 10 by controlling the tilting angle of a swash plate in the hydraulic pump 10 under command from the controller 100, to be discussed later.

An auxiliary hydraulic line 31, the control valve 5, and a pressure sensor 40 are attached to a hydraulic line 30 that supplies the hydraulic fluid from the hydraulic pump 10 to the parts ranging from the boom cylinder 3*a* to a traveling motor 3*d*. The auxiliary hydraulic line 31 is a junction line attached to the hydraulic line 30 via the check valve 6, to be discussed later. The control valve 5 is made up of a plurality of spool type directional control valves that control the direction and flow rate of the hydraulic fluid supplied to the actuators. The hydraulic sensor 40 detects the delivery pressure of the hydraulic pump 10. Supplied with the pilot hydraulic fluid through its pilot pressure receiving part, the control valve 5 switches the spool positions of each directional control valve to feed each hydraulic actuator with the hydraulic fluid from the hydraulic pump 10, thereby driving the arm 1*b* and other parts. The pressure sensor 40 outputs the detected delivery pressure of the hydraulic pump 10 to the controller 100, to be discussed later.

The spool positions of each directional control valve in the control valve 5 may be switched by operation of control levers of the operating devices 4 and 24. With their control levers operated, the operating devices 4 and 24 supply pilot primary hydraulic fluid to the pilot pressure receiving part of the control valve 5 via a pilot secondary hydraulic line, the pilot primary hydraulic fluid being fed from the pilot hydraulic pump 11 via a pilot primary hydraulic line, not shown. The operating device 4 is designed to operate the boom cylinder 3*a* serving as the first hydraulic actuator. The operating device 24 collectively represents devices that are designed to operate the actuators, serving as second hydraulic actuators, except for the boom cylinder 3*a*.

The operating device 4 with a pilot valve 4A inside is connected via a pilot line to the pressure receiving part of the spool type directional control valve in the control valve 5 that controls the drive of the boom cylinder 3*a*. The pilot valve 4A outputs a hydraulic signal to the pilot pressure receiving part of the control valve 5 in accordance with the tilting direction and operation amount of the control lever of the operating device 4. The spool type directional control valve for controlling the drive of the boom cylinder 3*a* is switched positionally in response to the hydraulic signal input from the operating device. The spool type directional control valve thus controls the drive of the boom cylinder 3*a* by controlling the flow of the hydraulic fluid delivered by the hydraulic pump 10 in accordance with the switching position of the valve. It should be noted here that a pressure sensor 41 serving as an operation amount detector is attached to the pilot line through which passes a hydraulic signal for driving the boom cylinder 3*a* in a manner lowering the boom 1*a* in the lowering direction (the signal is called the boom lowering operation signal Pd). The pressure sensor 41 outputs the detected boom lowering operation signal Pd to the controller 100.

The operating device 24 with a pilot valve 24A inside is connected via a pilot line to the pressure receiving part of the spool type directional control valves in the control valve 5 that control the drive of the actuators except for that of the boom cylinder 3*a*. The pilot valve 24A outputs a hydraulic signal to the pilot pressure receiving part of the control valve 5 in accordance with the tilting direction and operation amount of the control lever of the operating device 24. The spool type directional control valve for controlling the drive of the corresponding actuator is switched positionally in response to the hydraulic signal input from the operating device. The spool type directional control valve thus controls the drive of the corresponding actuator by controlling the flow of the hydraulic fluid delivered by the hydraulic pump 10 in accordance with the switching position of the valve.

Two pilot lines connecting the pilot valve 24A of the operating device 24 to the pressure receiving part of the control valve 5 are provided with pressure sensors 42 and 43 that detect the respective pilot pressures. The pressure sensors 42 and 43 output the detected operation amount signals from the operating device 24 to the controller 100, to be discussed later.

Described next is the power regeneration device 70 that regenerates power. The power regeneration device 70 includes a bottom-side hydraulic line 32, a regeneration circuit 33, a selector valve 7, a solenoid selector valve 8, the inverter 9A, the chopper 9B, the electrical storage device 9C, a hydraulic motor 13 serving as a regenerative hydraulic motor, an electric motor 14, an auxiliary hydraulic pump 15, and the controller 100.

The bottom-side hydraulic line 32 is a line through which flows the hydraulic fluid returning to the tank 12 when the boom cylinder 3*a* is retracted (the fluid is called the return hydraulic fluid). One end of the bottom-side hydraulic line 32 is connected to a bottom-side oil chamber 3*a*1 of the boom cylinder 3*a*, and the other end of the bottom-side hydraulic line 32 is connected to a connection port of the control valve 5. A pressure sensor 44 and the selector valve 7 are attached to the bottom-side hydraulic line 32, the pressure sensor 44 detecting the pressure in the bottom-side oil chamber 3*a*1 of the boom cylinder 3*a*, the selector valve 7 selecting whether or not to discharge the return hydraulic fluid from the bottom-side oil chamber 3*a*1 of the boom cylinder 3*a* into the tank 12 via the control valve 5. The pressure sensor 44 outputs the detected pressure in the bottom-side oil chamber 3*a*1 to the controller 100, to be discussed later.

A spring 7*b* is attached to one port of the selector valve 7, and a pilot pressure receiving part 7*a* is attached to the other port of the selector valve 7. Depending on whether the pilot hydraulic fluid is fed to the pilot pressure receiving part 7*a*, the selector valve 7 switches its spool positions to control communication/interruption of the return hydraulic fluid flowing from the bottom-side oil chamber 3*a*1 of the boom cylinder 3*a* into the control valve 5. The pilot hydraulic fluid is supplied from the pilot hydraulic pump 11 to the pilot pressure receiving part 7*a* via the solenoid selector valve 8, to be discussed later.

The hydraulic fluid output from the pilot hydraulic pump 11 is input to the input port of the solenoid selector valve 8. Meanwhile, a command signal output from the controller 100 is input to an operation part of the solenoid selector valve 8. In accordance with this command signal, the solenoid selector valve 8 controls supply/interruption of the pilot hydraulic fluid fed from the pilot hydraulic pump 11 to a pilot operation part 7*a* of the selector valve 7.

One end of the regeneration circuit 33 is connected between the selector valve 7 of the bottom-side hydraulic line 32 and the bottom-side oil chamber 3*a*1 of the boom cylinder 3*a*, and the other end of the regeneration circuit 33 is connected to the inlet port of the hydraulic motor 13. This connection guides the return hydraulic fluid from the bottom-side oil chamber 3*a*1 into the tank 12 via the hydraulic motor 13.

The hydraulic motor 13 serving as a regenerative hydraulic motor is mechanically connected to an auxiliary hydraulic pump 15. The drive power of the hydraulic motor 13 rotates the auxiliary hydraulic pump 15.

One end of the auxiliary hydraulic line 31 is connected to the delivery port of the auxiliary hydraulic pump 15 serving as a first hydraulic pump, and the other end of the auxiliary hydraulic line 31 is connected to the hydraulic line 30. The auxiliary hydraulic line 31 is provided with the check valve 6 that allows the hydraulic fluid from the auxiliary hydraulic pump 15 to flow into the hydraulic line 30 while preventing the hydraulic fluid from the hydraulic line 30 from flowing into the auxiliary hydraulic pump 15.

The auxiliary hydraulic pump 15 has a regulator 15A serving as a first adjustor. The regulator 15A regulates the delivery flow rate of the auxiliary hydraulic pump 15 by controlling the tilting angle of the swash plate in the auxiliary hydraulic pump 15 under command from the controller 100, to be discussed later.

The hydraulic motor 13 is further connected mechanically to the electric motor 14. The drive power of the hydraulic motor 13 causes the electric motor 14 to generate power. The electric motor 14 is electrically connected to the inverter 9A that controls revolution speed, to the chopper 9B that boosts voltage, and to the electrical storage device 9C that stores the generated electric power.

The controller 100 receives an estimated pump flow rate signal input from the hydraulic pump 10 in addition to the signals from the above-mentioned pressure sensors, the estimated pump flow rate signal being calculated by a vehicle body controller 200 serving as a host controller.

The controller 100 receives the input of the delivery pressure of the hydraulic pump 10 detected by the pressure sensor 40, a lowering-side pilot pressure signal Pd detected by the pressure sensor 41 from the pilot valve 4A in the operating device 4, a pilot pressure signal detected by the pressure sensors 42 and 43 from the pilot valve 24A in the operating device 24, a pressure signal detected by the pressure sensor 44 from the bottom-side oil chamber 3*a*1 in the boom cylinder 3*a*, and the estimated pump flow rate signal from the vehicle body controller 200. The controller 100 proceeds to perform calculations in accordance with these input values, before outputting control commands to the solenoid selector valve 8, inverter 9A, hydraulic pump regulator 10A, and auxiliary hydraulic pump regulator 15A.

The solenoid selector valve 8 is switched by a command signal from the controller 100 to feed the hydraulic fluid from the pilot hydraulic pump 11 to the selector valve 7. The inverter 9A is controlled to a desired revolution speed by a signal from the controller 100. The auxiliary hydraulic pump 15 and hydraulic pump 10 are controlled to desired displacements respectively by signals from the controller 100.

Outlined below is the operation of the above-described first embodiment of the present invention in the form of the hydraulic fluid energy regeneration device for a work machine.

First, operating the control lever of the operating device 4 shown in FIG. 2 in the boom lowering direction transmits the pilot pressure Pd from the pilot valve 4A to the pilot pressure receiving part of the control valve 5. The transmitted pilot pressure Pd switches the spool type directional control valve in the control valve 5 that controls the drive of the boom cylinder 3*a*. This causes the hydraulic fluid from the hydraulic pump 10 to flow into a rod-side oil chamber 3*a*2 in the boom cylinder 3*a* via the control valve 5. As a result, the piston rod of the boom cylinder 3*a* is retracted. Concomitantly, the return hydraulic fluid discharged from the bottom-side oil chamber 3*a*1 in the boom cylinder 3*a* is guided into the tank 12 through the bottom-side hydraulic line 32, through the selector valve 7 in a communicating state, and through the control valve 5.

At this point, the controller 100 is receiving the input of the delivery pressure signal of the hydraulic pump 10 detected by the pressure sensor 40, the pressure signal detected by the pressure sensor 44 from the bottom-side oil chamber 3*a*1 in the boom cylinder 3*a*, the lowering-side pilot pressure signal Pd of the pilot valve 4A detected by the pressure sensor 41, and the estimated pump flow rate signal from the vehicle body controller 200.

In that state, the operator may operate the control lever of the operating device 4 in the boom lowering direction in such a manner as to equal or exceed a prescribed value. This causes the controller 100 to output a switching command to the solenoid selector valve 8, a revolution speed command to the inverter 9A, a displacement command to the regulator 15A of the auxiliary hydraulic pump 15, and a displacement command to the regulator 10A of the hydraulic pump 10.

As a result, the selector valve 7 is switched to the interrupting position. This interrupts the hydraulic line to the control valve 5, causing the return hydraulic fluid from the bottom-side oil chamber 3*a*1 in the boom cylinder 3*a* to flow into the regeneration circuit 33. The return hydraulic fluid drives the hydraulic motor 13 before being discharged to the tank 12.

The drive power of the hydraulic motor 13 rotates the auxiliary hydraulic pump 15. The hydraulic fluid delivered by the auxiliary hydraulic pump 15 flows through the auxiliary hydraulic line 31 and the check valve 6 to join the hydraulic fluid delivered by the hydraulic pump 10. The controller 100 outputs a displacement command to the regulator 15A of the auxiliary hydraulic pump 15 in a manner assisting the hydraulic pump 10 with power. The controller 100 further outputs a displacement command to the regulator 10A in a manner reducing the displacement of the hydraulic pump 10 by as much as the flow rate of the hydraulic fluid supplied from the auxiliary hydraulic pump 15.

Of the hydraulic energy input to the hydraulic motor 13, the excess energy not consumed by the auxiliary hydraulic pump 15 is used to drive the electric motor 14 to generate power. The electric energy generated by the electric motor 14 is stored into the electrical storage device 9C.

In the first embodiment, the energy of the hydraulic fluid discharged from the boom cylinder 3*a* is recovered by the hydraulic motor 13. The recovered energy is used as the drive power of the auxiliary hydraulic pump 15 to assist the hydraulic pump 10 with power. Any excess power is stored into the electrical storage device 9C via the electric motor 14. In this manner, energy is efficiently utilized and fuel economy is improved.

Figure 3:
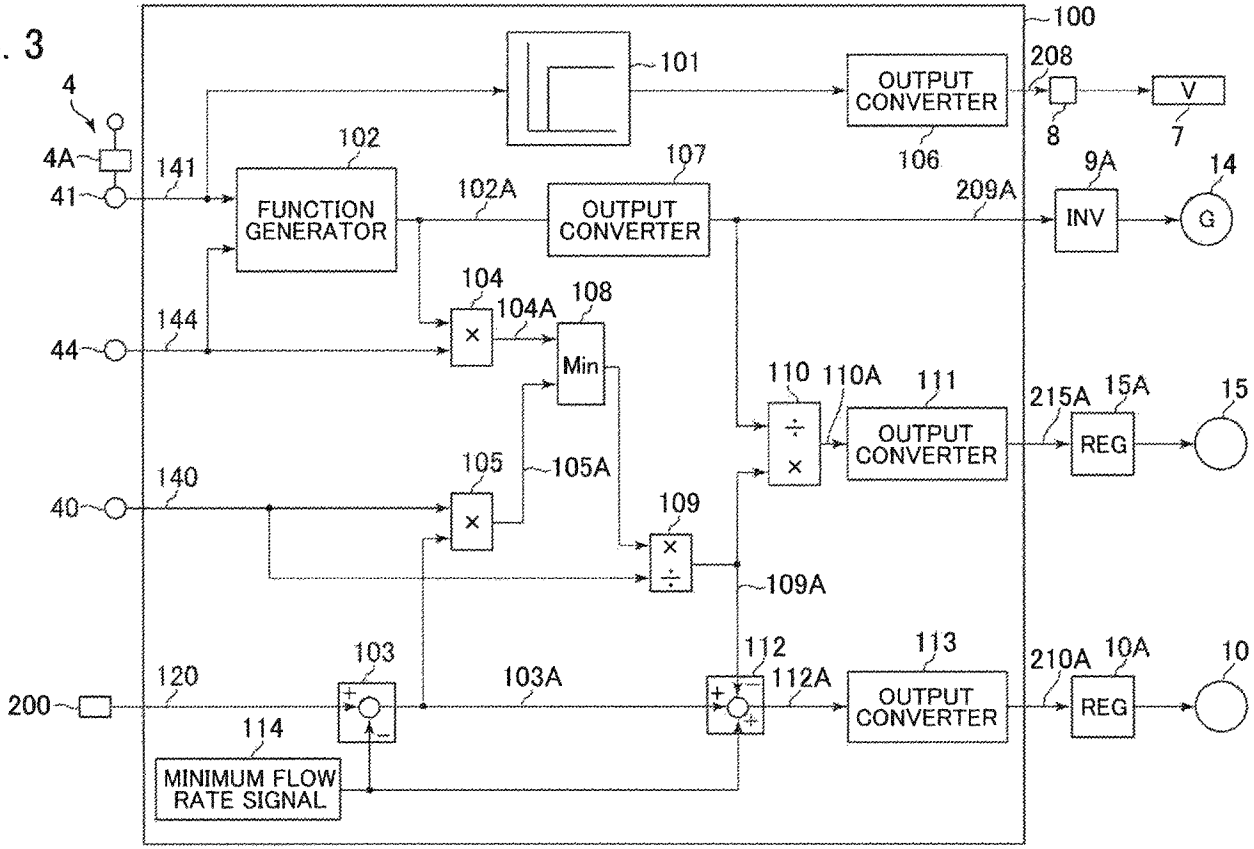
FIG. 3 is a block diagram of a controller constituting part of the hydraulic fluid energy regeneration device for a work machine, the hydraulic fluid energy regeneration device being practiced as the first embodiment.
Figure 4:
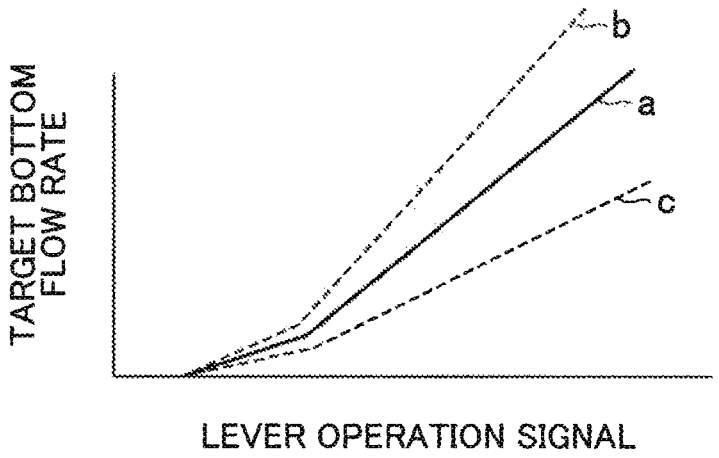
FIG. 4 is a characteristic diagram explanatory of the characteristics of a second function generator in the controller constituting part of the hydraulic fluid energy regeneration device for a work machine, the hydraulic fluid energy regeneration device being practiced as the first embodiment.

The control exercised by the controller 100 is outlined below using FIGS. 3 and 4. FIG. 3 is a block diagram of the controller constituting part of the hydraulic fluid energy regeneration device for a work machine, the hydraulic fluid energy regeneration device being practiced as the first embodiment, and FIG. 4 is a characteristic diagram explanatory of the control characteristics of the controller constituting part of the hydraulic fluid energy regeneration device for a work machine, the hydraulic fluid energy regeneration device being practiced as the first embodiment. In FIGS. 3 and 4, the same reference characters as those in FIGS. 1 and 2 designate the same or corresponding parts, and their detailed explanations are omitted where redundant.

The controller 100 shown in FIG. 3 includes a first function generator 101, a second function generator 102, a first subtraction computing unit 103, a first multiplication computing unit 104, a second multiplication computing unit 105, a first output converter 106, a second output converter 107, a minimum value selection computing part 108, a first division computing unit 109, a second division computing unit 110, a third output converter 111, a second subtraction computing unit 112, a fourth output converter 113, and a minimum flow rate signal command part 114.

As shown in FIG. 3, the first function generator 101 receives a lowering-side pilot pressure Pd of the pilot valve 4A in the operating device 4, the lowering-side pilot pressure Pd being detected by the pressure sensor 41 and input as a lever operation signal 141. The first function generator 101 has a table in which a switching start point for the lever operation signal 141 is stored beforehand.

When the lever operation signal 141 is below the switching start point, the first function generator 101 outputs an OFF signal to the first output converter 106; when the lever operation signal 141 exceeds the switching start point, the first function generator 101 outputs an ON signal to the first output converter 106. The first output converter 106 converts the input signal into a control signal for the solenoid selector valve 8 and outputs the control signal as a solenoid valve command 208 to the solenoid selector valve 8. This activates the solenoid selector valve 8 to switch the selector valve 7. That in turn causes the hydraulic fluid in the bottom-side oil chamber 3*a*1 of the boom cylinder 3*a* to flow toward the regeneration circuit 33.

The lowering-side pilot pressure Pd is input to one input port of the second function generator 102 as the lever operation signal 141, and the pressure detected by the pressure sensor 44 from the bottom-side oil chamber 3*a*1 in the boom cylinder 3*a* is input to another input port of the second function generator 102 as a pressure signal 144. On the basis of these input signals, the second function generator 102 calculates a target bottom flow rate for the boom cylinder 3*a*.

The operation of the second function generator 102 is explained below in detail using FIG. 4. FIG. 4 is a characteristic diagram explanatory of the characteristics of the second function generator in the controller constituting part of the hydraulic fluid energy regeneration device for a work machine, the hydraulic fluid energy regeneration device being practiced as the first embodiment.

In FIG. 4, the horizontal axis represents the operation amount of the lever operation signal 141, and the vertical axis denotes the target bottom flow rate (i.e., target flow rate of the return hydraulic fluid flowing out of the bottom-side oil chamber 3*a*1 in the boom cylinder 3*a*). In FIG. 4, a basic characteristic line "a" indicated by solid line is set with a view to obtaining the same characteristic as in the existing control of return hydraulic fluid by means of the control valve 5. A characteristic line "b" indicated by upper broken line and a characteristic line "c" indicated by lower broken line denote cases where the characteristic line "a" is corrected by the pressure signal 144 from the bottom-side oil chamber 3*a*1.

Specifically, when the pressure signal 144 of the bottom-side oil chamber 3*a*1 is raised, the inclination of the basic characteristic line "a" is increased for correction in the direction of the characteristic line "b," with the characteristic continuously changed correspondingly. Conversely, when the pressure signal 144 is lowered, the inclination of the basic characteristic line "a" is reduced for correction in the direction of the characteristic line "c," with the characteristic continuously changed correspondingly. In this manner, the second function generator 102 calculates the target bottom flow rate serving as the basis for the correction in accordance with the lever operation signal 141. The second function generator 102 then corrects the target bottom flow rate in keeping with the changing pressure signal 144 of the bottom-side oil chamber 3*a*1, thereby calculating a final target bottom flow rate.

Returning to FIG. 3, the second function generator 102 outputs a final target bottom flow rate signal 102A to the second output converter 107 and to the first multiplication computing unit 104. The second output converter 107 converts the input final target bottom flow rate signal 102A into a target electric motor revolution speed, and outputs the target electric motor revolution speed as a revolution speed command signal 209A to the inverter 9A. In this manner, the revolution speed of the electric motor 14 corresponding to the displacement of the hydraulic motor 13 is controlled. The revolution speed command signal 209A is also input to the second division computing unit 110.

An estimated pump flow rate signal 120 from the vehicle body controller 200 and a minimum flow rate signal from the minimum flow rate signal command part 114 are input to the first subtraction computing unit 103. The first subtraction computing unit 103 calculates the difference between the two inputs as a demanded pump flow rate signal 103A, and outputs the demanded pump flow rate signal 103A to the second multiplication computing unit 105 and to the second subtraction computing unit 112. In this case, the estimated pump flow rate signal 120 is an estimated value of the delivery flow rate of the hydraulic pump 10.

The final target bottom flow rate signal 102A from the second function generator 102 and the pressure signal 144 from the bottom-side oil chamber 3*a*1 are input to the first multiplication computing unit 104. The first multiplication computing unit 104 calculates the product of the two input signals as a recovered power signal 104A, and outputs the recovered power signal 104A to the minimum value selection computing part 108.

The delivery pressure of the hydraulic pump 10 detected by the pressure sensor 40 is input as a pressure signal 140 to one input port of the second multiplication computing unit 105, and the demanded pump flow rate signal 103A calculated by the first subtraction computing unit 103 is input to another input port of the second multiplication computing unit 105. The second multiplication computing unit 105 calculates the product of the two inputs as a demanded pump power signal 105A, and outputs the demanded pump power signal 105A to the minimum value selection computing part 108.

The recovered power signal 104A from the first multiplication computing unit 104 and the demanded pump power signal 105A from the second multiplication computing unit 105 are input to the minimum value selection computing part 108. The minimum value selection computing part 108 selects the smaller of the two inputs as a target assist power signal 108A for the auxiliary hydraulic pump 15, and outputs the target assist power signal 108A to the first division computing unit 109.

In terms of equipment efficiency, rather than have the recovered power converted by the electric motor 14 into electric energy for storage into the electrical storage device 9C for reuse, it is more efficient to have the recovered power used by the auxiliary hydraulic pump 15 as much as possible. This minimizes power losses and brings about higher efficiency. When the minimum value selection computing part 108 selects the smaller of the recovered power signal 104A and the demanded pump power signal 105A, recovered power is supplied to the auxiliary hydraulic pump as much as possible in a manner not exceeding the demanded pump power signal 105A.

The target assist power signal 108A from the minimum value selection computing part 108 and the pressure signal 140 representing the delivery pressure of the hydraulic pump 10 are input to the first division computing unit 109. The first division computing unit 109 divides the target assist power signal 108A by the pressure signal 140 to obtain a target assist flow rate signal 109A. The first division computing unit 109 proceeds to output the target assist flow rate signal 109A to the second division computing unit 110 and to the second subtraction computing unit 112.

The target assist flow rate signal 109A from the first division computing unit 109 and the revolution speed command signal 209A from the second output converter 107 are input to the second division computing unit 110. The second division computing unit 110 divides the target assist flow rate signal 109A by the revolution speed command signal 209A to obtain a target displacement signal 110A for the auxiliary hydraulic pump 15. The second division computing unit 110 then outputs the target displacement signal 110A to the third output converter 111.

The third output converter 111 converts the input target displacement signal 110A into a tilting angle, for example, and outputs the tilting angle as a displacement command signal 215A to the regulator 15A. This allows the displacement, of the auxiliary hydraulic pump 15 to be controlled.

The demanded pump flow rate signal 103A from the first subtraction computing unit 103, the target assist flow rate signal 109A from the first division computing unit 109, and the minimum flow rate signal from the minimum flow rate signal command part 114 are input to the second subtraction computing unit 112. The second subtraction computing unit 112 adds the demanded pump flow rate signal 103A and the minimum flow rate signal to calculate the estimated pump flow rate signal 120 input from the vehicle body controller 200. The second subtraction computing unit 112 then calculates the difference between the estimated pump flow rate signal 120 and the target assist flow rate signal 109A as a target pump flow rate signal 112A, and outputs the target pump flow rate signal 112A to the fourth output converter 113.

The fourth output converter 113 converts the input target pump flow rate signal 112A into a tilting angle, for example, and outputs the tilting angle as a displacement command signal 210A to the regulator 10A. This allows the displacement of the hydraulic pump 10 to be controlled.

Explained below using FIGS. 2 and 3 is the operation of the control logic governing the above-described first embodiment of the present invention in the form of the hydraulic fluid energy regeneration device for a work machine.

Operating the control lever of the operating device 4 in the boom lowering direction cause the pilot valve 4A to generate a pilot pressure Pd. The pilot pressure Pd is detected by the pressure sensor 41 and is input to the controller 100 as the lever operation signal 141. At this point, the delivery pressure of the hydraulic pump 10 is detected by the pressure sensor 40 and is input to the controller 100 as the pressure signal 140. The pressure of the bottom-side oil chamber 3*a*1 in the boom cylinder 3*a* is detected by the pressure sensor 44 and is input to the controller 100 as the pressure signal 144.

In the controller 100, the lever operation signal 141 is input to the first function generator 101 and to the second function generator 102. When the lever operation signal 141 exceeds the switching start point, the first function generator 101 outputs an ON signal to the solenoid selector valve 8 via the first output converter 106. This causes the hydraulic fluid from the pilot hydraulic pump 11 to be input to the pilot operation part 7*a* of the selector valve 7 via the solenoid selector valve 8. As a result, the switching operation is performed in a direction interrupting the bottom-side hydraulic line 32 (i.e., in the direction of the shut-off side of the selector valve 7). This interrupts the hydraulic line that would allow the return hydraulic fluid from the bottom-side oil chamber 3*a*1 in the boom cylinder 3*a* to flow into the tank 12 via the control valve 5, thereby causing the return hydraulic fluid to flow into the hydraulic motor 13 via the regeneration circuit 33.

Also, the lever operation signal 141 and the pressure signal 144 from the bottom-side oil chamber 3*a*1 are input to the second function generator 102 in the controller 100. The second function generator 102 calculates the final target bottom flow rate signal 102A in accordance with the lever operation signal 141 and with the pressure signal 144 from the bottom-side oil chamber 3*a*1. The second output converter 107 converts the final target bottom flow rate signal 102A into a target electric motor revolution speed, and outputs the target electric motor revolution speed to the inverter 9A as the revolution speed command signal 209A.

In this manner, the revolution speed of the electric motor 14 is controlled to a desired revolution speed level. As a result, the flow rate of the return hydraulic fluid discharged from the bottom-side oil chamber 3*a*1 in the boom cylinder 3*a* is regulated to permit smooth cylinder action in response to the lever operation on the operating device 4.

Meanwhile, the estimated pump flow rate signal 120 sent from the vehicle body controller 200 to the controller 100 is input to the first subtraction computing unit 103 along with the minimum flow rate signal from the minimum flow rate signal command part 114. The first subtraction computing unit 103 calculates the demanded pump flow rate signal 103A.

The final target bottom flow rate signal 102A calculated by the second function generator 102 and the pressure signal 144 from the bottom-side oil chamber 3*a*1 are input to the first multiplication computing unit 104. The first multiplication computing unit 104 calculates the recovered power signal 104A. The demanded pump flow rate signal 103A calculated by the first subtraction computing unit 103 and the pressure signal 140 from the hydraulic pump 10 are input to the second multiplication computing unit 105. The second multiplication computing unit 105 then calculates the demanded pump power signal 105A. The recovered power signal 104A and the demanded pump power signal 105A are input to the minimum value selection computing part 108.

The minimum value selection computing part 108 outputs the smaller of the two inputs as the target assist power signal 108A. This operation is intended to calculate the power (amount of energy) within the recovered power signal 104A that can be preferentially used by the auxiliary hydraulic pump 15 in a manner not exceeding the demanded pump power signal 105A. That in turn minimizes losses in conversion to electric energy and permits efficient regeneration operation.

The target assist power signal 108A calculated by the minimum value selection computing part 108 and the pressure signal 140 representing the delivery pressure of the hydraulic pump 10 are input to the first division computing unit 109. The first division computing unit 109 calculates the target assist flow rate signal 109A.

The target assist flow rate signal 109A calculated by the first division computing unit 109 and the revolution speed command signal 209A calculated by the second output converter 107 are input to the second division computing unit 110. The second division computing unit 110 calculates the target displacement signal 110A. The third output converter 111 converts the target displacement signal 110A into a tilting angle, for example, and outputs the tilting angle as the displacement command signal 215A to the regulator 15A.

In this manner, the auxiliary hydraulic pump 15 is controlled to supply the hydraulic fluid as much as possible to the hydraulic pump 10 in a manner not exceeding the demanded pump power signal 105A. As a result, recovered power is utilized efficiently.

The demanded pump flow rate signal 103A calculated by the first subtraction computing unit 103, the target assist flow rate signal 109A calculated by the first division computing unit 109, and the minimum flow rate signal from the minimum flow rate signal command part 114 are input to the second subtraction computing unit 112. The second subtraction computing unit 112 calculates the target pump flow rate signal 112A. The fourth output converter 113 converts the target pump flow rate signal 112A into a tilting angle, for example, and outputs the tilting angle as the displacement command signal 210A to the regulator 10A.

In this manner, the displacement of the hydraulic pump 10 is reduced by as much as the flow rate of the hydraulic fluid supplied from the auxiliary hydraulic pump 15, which lowers the output of the hydraulic pump 10. The flow rate of the hydraulic fluid fed to the control valve 5 remains constant regardless of whether hydraulic fluid is supplied from the auxiliary hydraulic pump 15. This makes it possible to maintain good maneuverability in response to the control lever of the operating device 25 being operated.

According to the above-described hydraulic fluid energy regeneration device for a work machine practiced as the first embodiment of the present invention, the auxiliary hydraulic pump 15 coupled mechanically to the regeneration hydraulic motor 13 is directly driven by recovered energy. That means there occurs little loss in temporarily storing the recovered energy. With energy loss reduced during energy conversion, energy is utilized efficiently.

Also according to the above-described hydraulic fluid energy regeneration device for a work machine practiced as the first embodiment, the displacement of the hydraulic pump 10 is controlled to be reduced by as much as the hydraulic fluid supplied from the auxiliary hydraulic pump 15. This allows the flow rate of the hydraulic fluid fed to the control valve 5 to remain constant. That in turn makes it possible to maintain good maneuverability.

Second Embodiment

Figure 5:
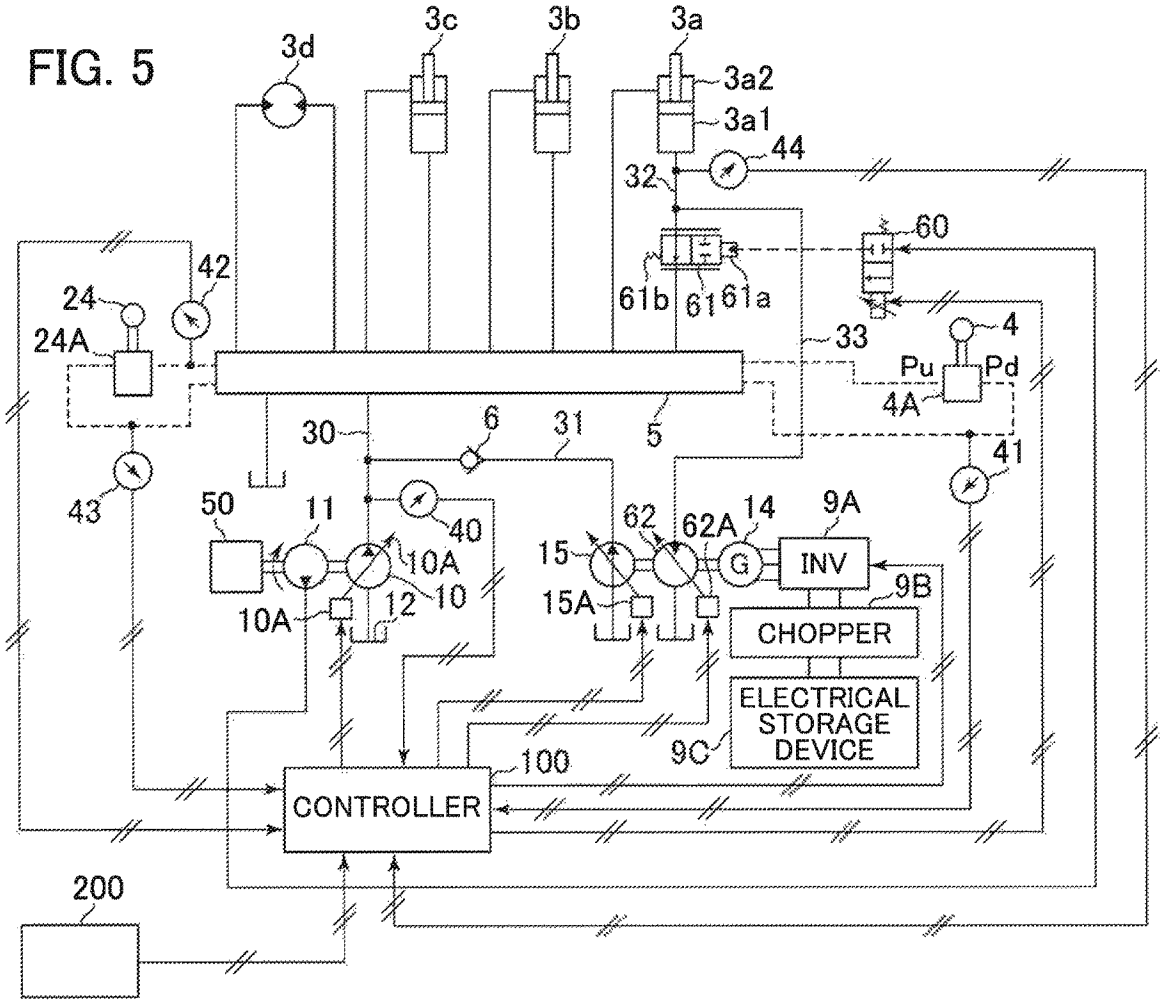
FIG. 5 is a schematic view of a drive control system constituting part of a hydraulic fluid energy regeneration device for a work machine, the hydraulic fluid energy regeneration device being practiced as a second embodiment of the present invention.
Figure 6:
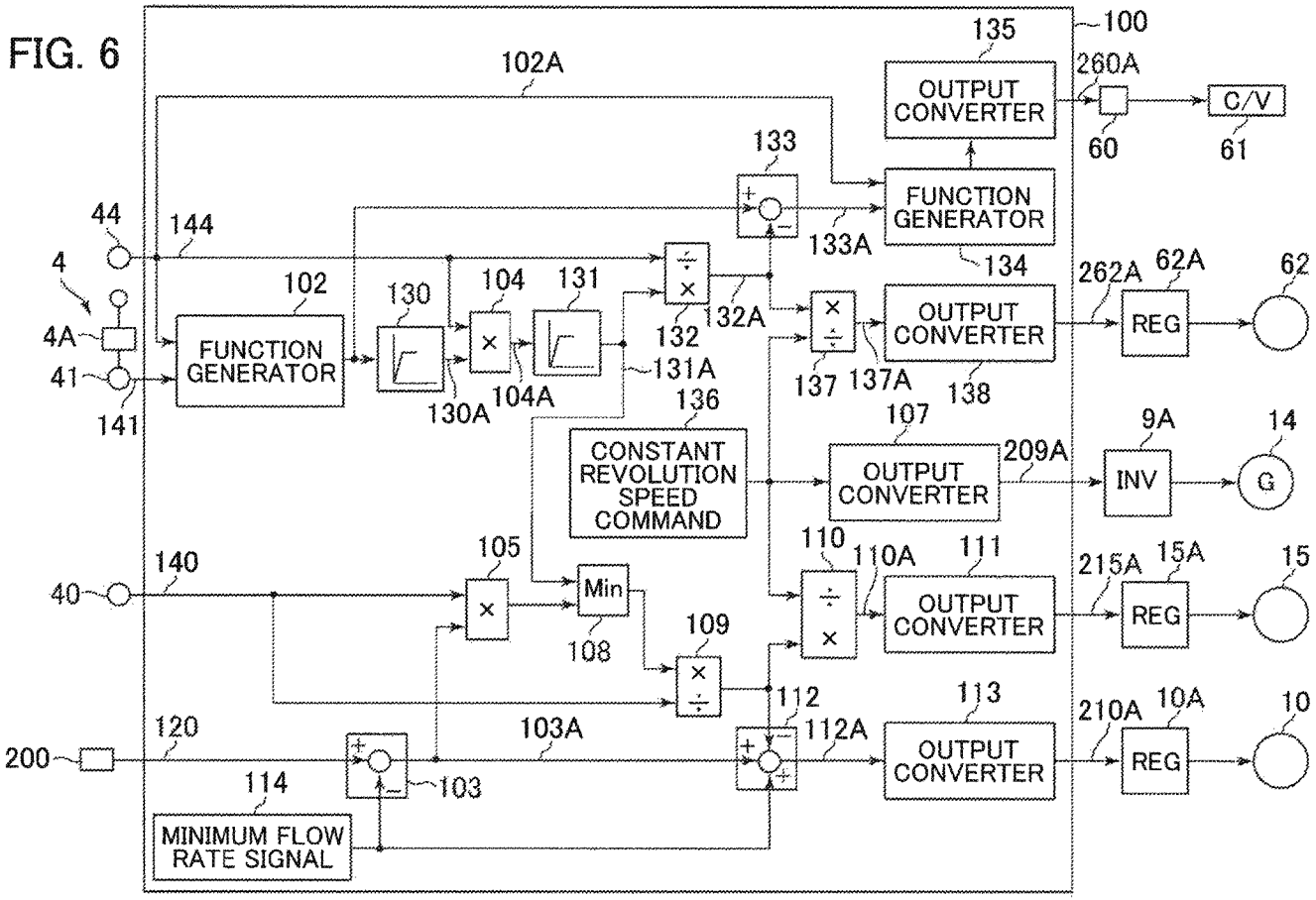
FIG. 6 is a block diagram of a controller constituting part of the hydraulic fluid energy regeneration device for a work machine, the hydraulic fluid energy regeneration device being practiced as the second embodiment.

Described below with reference to the accompanying drawings is a hydraulic fluid energy regeneration device for a work machine practiced as a second embodiment of the present invention. FIG. 5 is a schematic view of a drive control system constituting part of the hydraulic fluid energy regeneration device for a work machine, the hydraulic fluid energy regeneration device being practiced as the second embodiment, and FIG. 6 is a block diagram of a controller constituting part of the hydraulic fluid energy regeneration device for a work machine, the hydraulic fluid energy regeneration device being practiced as the second embodiment. In FIGS. 5 and 6, the same reference characters as those in FIGS. 1 to 4 designate the same or corresponding parts, and their detailed explanations are omitted where redundant.

The hydraulic fluid energy regeneration device for a work machine shown in FIGS. 5 and 6 and practiced as the second embodiment of the invention is approximately made up of the same hydraulic power source and the same work implement, among others, as in the first embodiment, but has a different configuration. The difference is that the solenoid selector valve 8 is replaced with a solenoid proportional valve 60, the selector valve 7 with a control valve 61, and the hydraulic motor 13 with a variable displacement hydraulic motor 62 and that a motor regulator 62A for varying motor displacement is provided. The motor regulator 62A varies the displacement of the variable displacement hydraulic motor 62 under commands from the controller 100. The difference of the controller 100 in the second embodiment from its counterpart in the first embodiment is that there are provided a flow rate limit computing part 130, a power limit computing part 131, a third division computing unit 132, a third function generator 134, a fifth output converter 135, a constant revolution speed command part 136, a fourth division computing unit 137, and a sixth output converter 138.

In the second embodiment, the return hydraulic fluid from the bottom-side oil chamber 3*a*1 in the boom cylinder 3*a* is caused to branch by the control valve 61. Also, the electric motor 14 is rotated at a constant revolution speed to control the displacement of the variable displacement hydraulic motor 62, thereby controlling the flow rate for regeneration. In this manner, even if the boom cylinder 3*a* discharges an energy amount/flow rate exceeding either the maximum power of the electric motor 14 or a maximum recovery flow rate of the hydraulic motor 62, destruction of the equipment is prevented and the maneuverability of the boom is ensured. In reference to FIG. 5, the parts different from those in the first embodiment are explained below.

On the bottom-side hydraulic line 32, the selector valve 7 is replaced with the control valve 61. Given the return hydraulic fluid from the bottom-side oil chamber 3*a*1 in the boom cylinder 3*a*, the control valve 61 controls the branching flow being discharged to the tank 12 via the control valve 5.

A spring 61*b* is attached to one port of the control valve 61, and a pilot pressure receiving part 61*a* is attached to the other port of the control valve 61. The spool in the control valve 61 is moved in keeping with the pressure of the pilot hydraulic fluid input to the pilot pressure receiving part 61*a*. The opening area through which the hydraulic fluid flows is thus controlled. When the pressure of the pilot hydraulic fluid is at or higher than a predetermined value, the control valve 61 is completely shut off. This controls the hydraulic fluid flow branching from the return hydraulic fluid from the bottom-side oil chamber 3*a*1 in the boom cylinder 3*a* and discharged to the tank 12 via the control valve 5. The pilot pressure receiving part 61*a* is supplied with the pilot hydraulic fluid from the pilot hydraulic pump 11 via the solenoid proportional pressure reducing valve 60, to be discussed later.

The hydraulic fluid from the pilot hydraulic pump 11 is input to the input port of the solenoid proportional pressure reducing valve 60 in the second embodiment. Meanwhile, a command signal from the controller 100 is input to the operation part of the solenoid proportional pressure reducing valve 60. In keeping with the command signal, the spool positions of the solenoid proportional pressure reducing valve 60 are regulated. Accordingly, the pressure of the pilot hydraulic fluid fed from the pilot hydraulic pump 11 to the pilot pressure receiving part 61*a* of the control valve 61 is adjusted as needed.

The controller 100 outputs a control command to the solenoid proportional pressure reducing valve 60 to adjust the opening area of the control valve 61 in such a manner as to attain the target flow rate, calculated internally by the controller 100, of the discharged hydraulic fluid supposed to branch to the control valve 61.

The control of the controller 100 in the second embodiment is now outlined using FIG. 6. In reference to FIG. 6, the parts different from those in the first embodiment are explained below.

In the second embodiment, a target area signal 134A from the third function generator 134 is output to the fifth output converter 135. The fifth output converter 135 converts the input target opening area signal 135A into a control command for the solenoid proportional pressure reducing valve 60, and outputs the control command as a solenoid valve command signal 260A to the solenoid proportional pressure reducing valve 60. This permits control of the opening of the control valve 61 in a manner controlling the hydraulic fluid flow branching from the return hydraulic fluid from the bottom-side oil chamber 3*a*1 in the boom cylinder 3*a* and discharged to the tank 12 via the control valve 5. Also, a target displacement signal 137A from the fourth division computing unit 137 is output to the sixth output converter 138. The six output converter 138 converts the input target displacement signal 137A into a tilting angle, for example, and outputs the tilting angle as a displacement command signal 262A to the regulator 62A. This allows the displacement of the variable displacement hydraulic motor 62 to be controlled.

The controller 100 in the second embodiment is characterized in that the first function generator 101 and the first output converter 106 of the first embodiment are omitted and that the remaining computing units are supplemented with the flow rate limit computing part 130, power limit computing part 131, third division computing unit 132, third function generator 134, fifth output converter 135, constant revolution speed command part 136, fourth division computing unit 137, and sixth output converter 138.

As shown in FIG. 6, the final target bottom flow rate signal 102A calculated by the second function generator 102 is input to the flow rate limit computing part 130. The flow rate limit computing part 130 outputs a limited flow rate signal 130A subject to the upper limit of a maximum recovery flow rate of the variable displacement hydraulic motor 62. Since hydraulic motors generally have their maximum displacements fixed beforehand, the characteristic here is established to be in conformity with equipment specifications. The limited flow rate signal 130A is output to the first multiplication computing unit 104.

The limited flow rate signal 130A from the flow rate limit computing part 130 and the pressure signal 144 from the bottom-side oil chamber 3*a*1 are input to the first multiplication computing unit 104. The first multiplication computing unit 104 calculates the product of the two inputs as the recovered power signal 104A, and outputs the recovered power signal 104A to the power limit computing part 131.

The recovered power signal 104A calculated by the first multiplication computing unit 104 is input to the power limit computing part 131. The power limit computing part 131 outputs a limited recovered power signal 131A subject to the upper limit of the maximum power of the electric motor 14. Since the electric motor 14 also has its maximum power level generally fixed beforehand, the characteristic here is established to be in conformity with equipment specifications. The limited recovered power signal 131A is output to the third division computing unit 132 and to the minimum value selection computing part 108. The limits computed by the flow rate limit computing part 130 and by the power limit computing part 131 prevent destruction of the equipment.

The limited recovered power signal 131A from the power limit computing part 131 and the pressure signal 144 from the bottom-side oil chamber 3*a*1 are input to the third division computing unit 132. The third division computing unit 132 divides the limited recovered power signal 131A by the pressure signal 144 to obtain a target recovery flow rate signal 132A, and outputs the target recovery flow rate signal 132A to a third subtraction computing unit 133 and to the fourth division computing unit 137.

The final target bottom flow rate signal 102A from the second function generator 102 and the target recovery flow rate signal 132A from the third division computing unit 132 are input to the third subtraction computing unit 133. The third subtraction computing unit 133 calculates the difference between the two inputs as a target discharge flow rate signal 133A defining the hydraulic fluid flow supposed to branch to the control valve 61. The third subtraction computing unit 133 outputs the target discharge flow rate signal 133A to the third function generator 134.

The pressure detected by the pressure sensor 44 from the bottom-side oil chamber 3*a*1 in the boom cylinder 3*a* is input to one input port of the third function generator 134 as the pressure signal 144, and the target discharge flow rate signal 133A calculated by the third subtraction computing unit 133 defining the hydraulic fluid flow supposed to branch to the control valve 61 is input to another input port of the third function generator 134. The third function generator 134 calculates the target opening area of the control valve 61 using the orifice formula on the basis of these input signals. The third function generator 134 proceeds to output the target opening area signal 134A to the fifth output converter 135.

Here, the target opening area A of the control valve 61 is calculated using the equations (1) and (2) below. If Qt is assumed to stand for the target discharge flow rate, C for a flow rate coefficient, Pb for the pressure of the bottom-side oil chamber 3*a*1 in the boom cylinder 3*a*, A for the opening area of the control valve 61, and 0 MPa for the tank pressure, then $$Qt=CA\sqrt{Pb} \quad (1)$$

The equation solved for A is $$A_0=Q_0/(C\sqrt{P_b}) \quad (2)$$

The equation (2) above is thus used to calculate the opening area of the control vale 61.

The fifth output converter 135 converts the input target opening area signal 134A into a control command for the solenoid proportional pressure reducing valve 60, and outputs the control command as the solenoid valve command signal 260A to the solenoid proportional pressure reducing valve 60. This permits control of the opening of the control valve 61, thereby controlling the hydraulic fluid flow supposed to branch to the control valve 61.

The constant revolution speed command part 136 outputs the electric motor revolution speed command signal to the second output converter 107 to rotate the electric motor 14 at a constant maximum revolution speed. The second output converter 107 converts the input revolution speed command signal into a target electric motor revolution speed, and outputs the target speed as the revolution speed command signal 209A to the inverter 9A.

The constant revolution speed command part 136 also outputs the electric motor revolution speed command signal to the other port of the second division computing unit 110 and to the other port of the fourth division computing unit 137.

The target assist flow rate signal 109A from the first division computing unit 109 and the electric motor revolution speed command signal from the constant revolution speed command part 136 are input to the second division computing unit 110. The second division computing unit 110 divides the target assist flow rate signal 109A by the electric motor revolution speed command signal to obtain the target displacement signal 110A for the auxiliary hydraulic pump 15, and outputs the target displacement signal 110A to the third output converter 111.

The target recovery flow rate signal 132A from the third division computing unit 132 and the electric motor revolution speed command signal from the constant revolution speed command part 136 are input to the fourth division computing unit 137. The fourth division computing unit 137 divides the target recovery flow rate signal 132A by the electric motor revolution speed command signal to obtain the target displacement signal 137A for the variable displacement hydraulic motor 62, and outputs the target displacement signal 137A to the sixth output converter 138.

The sixth output converter 138 converts the input target displacement signal 137A into a tilting angle, for example, and outputs the tilting angle as the displacement command signal. 262A to the regulator 62A. This allows the displacement of the variable displacement hydraulic motor 62 to be controlled.

Explained below using FIGS. 5 and 6 is the operation of the control logic governing the above-described second embodiment of the present invention in the form of the hydraulic fluid energy regeneration device for a work machine.

The final target bottom flow rate signal 102A output from the second function generator 102 shown in FIG. 6 is limited by the flow rate limit computing part 130 to the limited flow rate signal 130A subject to the upper limit of the maximum recovery flow rate of the variable displacement hydraulic motor 62. This protects the variable displacement hydraulic motor 62 from being supplied with a hydraulic fluid flow higher than is allowed by specification. Destruction of the variable displacement hydraulic motor 62 is thus prevented.

Also, the final target bottom flow rate signal 102A thus limited is input to the first multiplication computing unit 104 along with the pressure signal 144 from the bottom-side oil chamber 3*a*1. The first multiplication computing unit 104 calculates the recovered power signal 104A.

The recovered power signal 104A thus calculated is limited by the power limit computing part 131 to the limited recovered power signal 131A subject to the upper limit of the maximum power of the electric motor 14. This prevents excess energy from being input to the electric motor shaft, thereby forestalling destruction or overspeed of the equipment.

The limited recovered power signal 131A from the power limit computing part 131 is input to the third division computing unit 132 along with the pressure signal 144 from the bottom-side oil chamber 3*a*1. The third division computing unit 132 calculates the target recovery flow rate signal 132A.

Furthermore, the target recovery flow rate signal 132A is input to the third subtraction computing unit 133 along with the final target bottom flow rate signal 102A. The third subtraction computing unit 133 calculates the target discharge flow rate signal 133A defining the hydraulic fluid flow supposed to branch to the control valve 61 in order to attain the boom cylinder speed desired by the operator.

The target discharge flow rate signal 133A is input to the third function generator 134 along with the pressure signal 144 from the bottom-side oil chamber 3*a*1. The third function generator 134 calculates the target opening area of the control valve 61. A signal representing the target opening area is output to the solenoid valve 60 as the solenoid valve command signal 260A via the fifth output converter 135.

In this manner, a portion of the discharged hydraulic fluid discharged from the boom cylinder 3*a* shown in FIG. 5 is caused to branch to the control valve 61. The hydraulic fluid flow not recovered by the variable displacement hydraulic motor 62 is thus allowed to flow to the control valve 61. This makes it possible to ensure the boom cylinder speed desired by the operator.

Returning to FIG. 6, the target recovery flow rate signal 132A from the third division computing unit 132 is input to the fourth division computing unit 137 along with the electric motor revolution speed command signal from the constant revolution speed command part 136. The constant revolution speed command part 136 calculates the target displacement of the variable displacement hydraulic motor 62. A signal representing the target displacement is output as the displacement command signal 262A to the regulator 62A via the sixth output converter 138.

In this manner, the variable displacement hydraulic motor 62 is supplied with the hydraulic fluid flow subject to flow rate and power limits imposed by the specifications of the equipment coupled to the rotating shaft. This prevents the input of excess power, thereby forestalling destruction or overspeed of the equipment.

The second embodiment was described above using an example in which the limit on the flow rate of recovered power and the limit on power are performed simultaneously. However, this is not limitative of the present invention. Alternatively, the limits may be selectively designed as needed in conformity with equipment specifications. For example, if the torque of the electric motor is high enough to eliminate the need for the limit on power, control logic that performs the limit on the flow rate alone may be created.

The above-described second embodiment of the present invention in the form of the hydraulic fluid energy regeneration device for a work machine provides the same advantageous effects as those of the first embodiment.

Also according to the above-described second embodiment of the present invention, the variable displacement hydraulic motor 62 for regeneration purposes is supplied with the hydraulic fluid flow subject to the limits on flow rate and on power imposed by the specifications of the equipment. The input of excess power is prevented. As a result, destruction or overspeed of the equipment is prevented, and the reliability of the equipment is enhanced.

Third Embodiment

Figure 7:
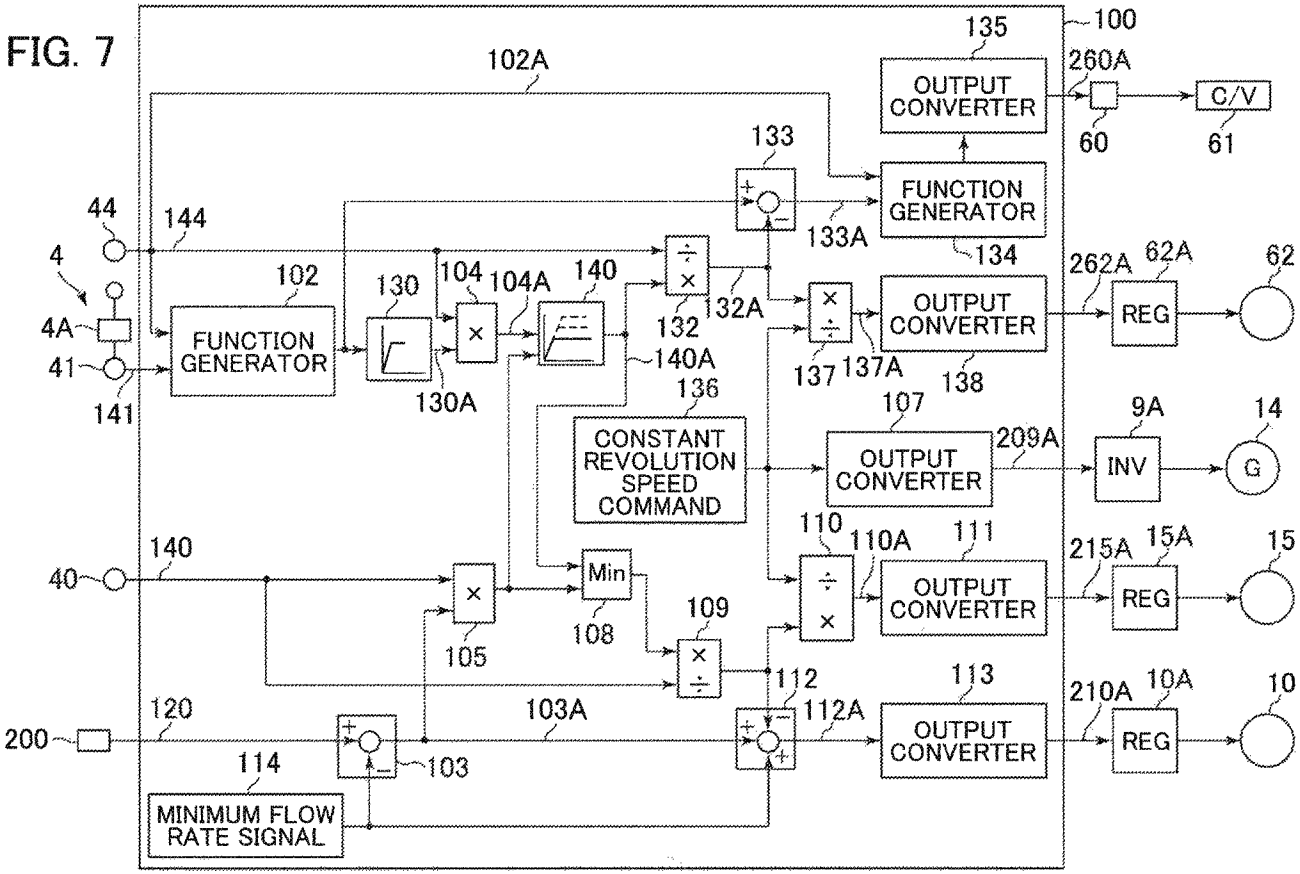
FIG. 7 is a block diagram of a controller constituting part of a hydraulic fluid energy regeneration device for a work machine, the hydraulic fluid energy regeneration device being practiced as a third embodiment of the present invention.
Figure 8:
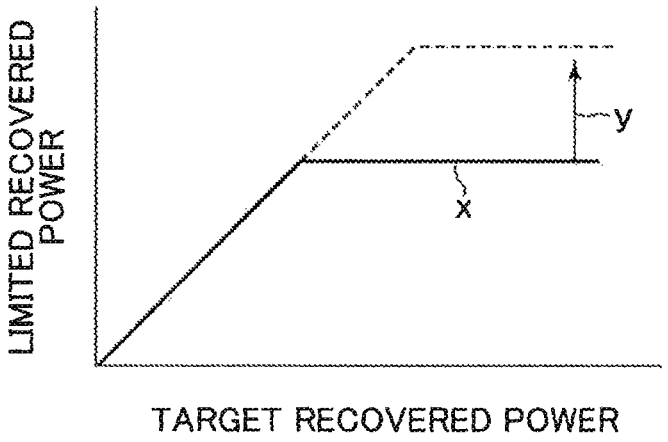
FIG. 8 is a characteristic diagram explanatory of the characteristics of a variable power limit computing part in the controller constituting part of the hydraulic fluid energy regeneration device for a work machine, the hydraulic fluid energy regeneration device being practiced as the third embodiment.

Described below with reference to the accompanying drawings is a hydraulic fluid energy regeneration device for a work machine practiced as a third embodiment of the present invention. FIG. 7 is a block diagram of a controller constituting part of the hydraulic fluid energy regeneration device for a work machine, the hydraulic fluid energy regeneration device being practiced as the third embodiment, and FIG. 8 is a characteristic diagram explanatory of the characteristics of a variable power limit computing part in the controller constituting part of the hydraulic fluid energy regeneration device for a work machine, the hydraulic fluid energy regeneration device being practiced as the third embodiment. In FIGS. 7 and 8, the same reference characters as those in FIGS. 1 to 6 designate the same or corresponding parts, and their detailed explanations are omitted where redundant.

The hydraulic fluid energy regeneration device for a work machine shown in FIGS. 7 and 8 and practiced as the third embodiment of the invention is approximately made up of the same hydraulic power source and the same work implement, among others, as in the second embodiment, but has a different control logic configuration. What makes the third embodiment different from the second embodiment is that a variable power limit computing part 140 replaces the power limit computing part 131 of the second embodiment. In the second embodiment, only the maximum power of the electric motor 14 serves as the limit on the hydraulic fluid flow to the variable displacement hydraulic motor 62. In the third embodiment, the sum of the maximum power of the electric motor 14 and the demanded pump power of the auxiliary hydraulic pump 15 is used to compute limits. This raises the upper limit on power, so that more energy is recovered and the effect of reducing fuel consumption is improved.

As shown in FIG. 7, the recovered power signal 104A computed by the first multiplication computing unit 104 and the demanded pump power signal 105A computed by the second multiplication computing unit 105 are input to the variable power limit computing part 140. The variable power limit computing part 140 outputs a limited recovered power signal 140A that is subject to the upper limit on the maximum power of the electric motor 14 and to the demanded power of the auxiliary hydraulic pump 15. The limited recovered power signal 140A is output to the third division computing unit 132 and to the minimum value selection computing part 108.

The computing of the variable power limit computing part 140 is explained below in detail using FIG. 8. In FIG. 8, the horizontal axis denotes the target recovered power represented by the recovered power signal 104A computed by the first multiplication computing unit 104, and the vertical axis represents the limited recovered power calculated by the variable power limit computing part 140. In FIG. 8, a solid-line characteristic line "x" defines an upper limit line in parallel to the horizontal axis with the maximum power of the electric motor 14. In this case, the demanded pump power signal 105A input from the second multiplication computing unit 105 is 0.

When the demanded pump power signal 105A input to the variable power limit computing part 140 is increased from 0, the upper limit line of the characteristic line "x" is shifted upward in the "y" direction by the amount of the increase. In other words, the variable power limit computing part 140 raises the upper limit of the limited recovered power by the amount of the demanded pump power being input.

This raises the upper limit on the target recovered power, increases recovered power, and improves the effect of reducing fuel consumption. Also, even if a level of energy exceeding the power of the electric motor 14 is input to the variable displacement hydraulic motor 62, the excess power is consumed by the auxiliary hydraulic pump 15. This protects the electric motor 14 against the input of power exceeding its specifications.

The above-described third embodiment of the present invention in the form of the hydraulic fluid energy regeneration device for a work machine provides the same advantageous effects as those of the first embodiment.

Also according to the above-described third embodiment of the present invention, the upper limit on the target recovered power is raised, recovered power is increased, and the effect of reducing fuel consumption is improved. As a result, destruction or overspeed of the equipment is prevented, and the reliability of the equipment is enhanced.

Fourth Embodiment

Figure 9:
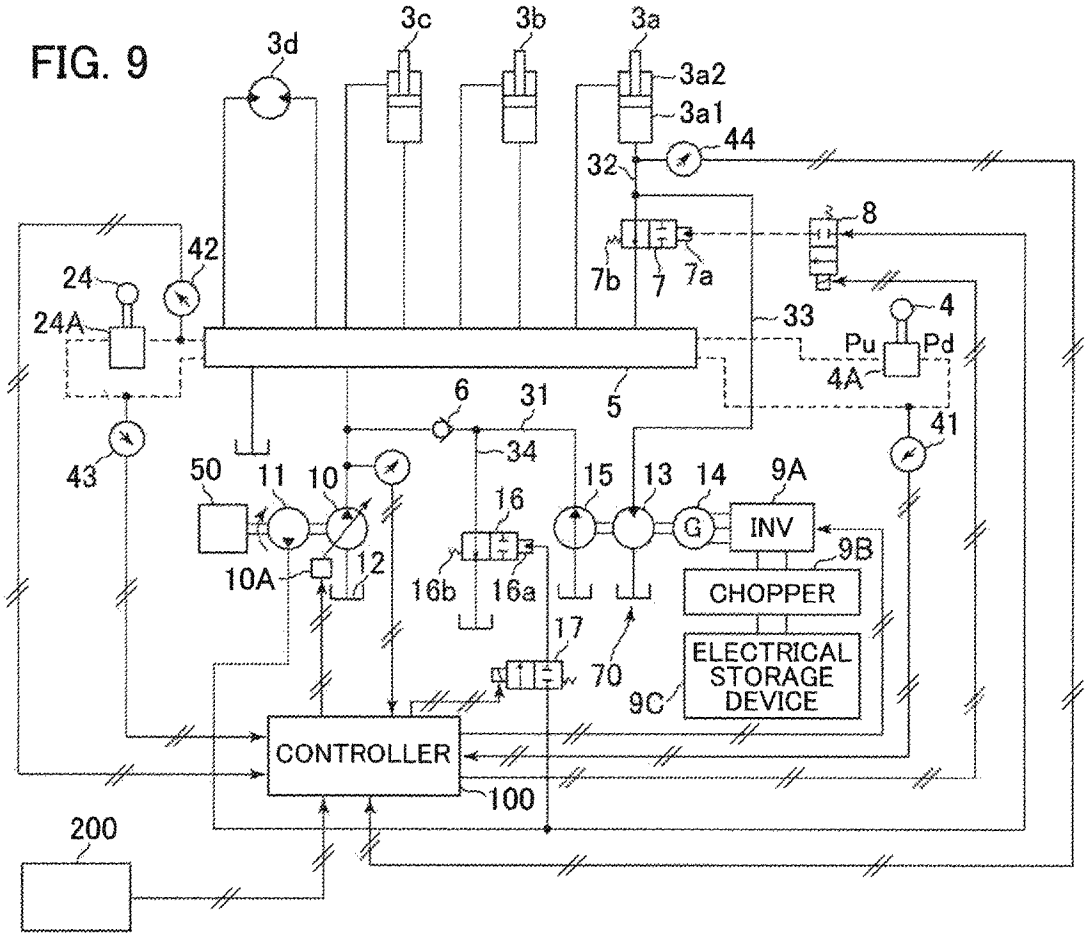
FIG. 9 is a schematic view of a drive control system constituting part of a hydraulic fluid energy regeneration device for a work machine, the hydraulic fluid energy regeneration device being practiced as a fourth embodiment of the present invention.
Figure 10:
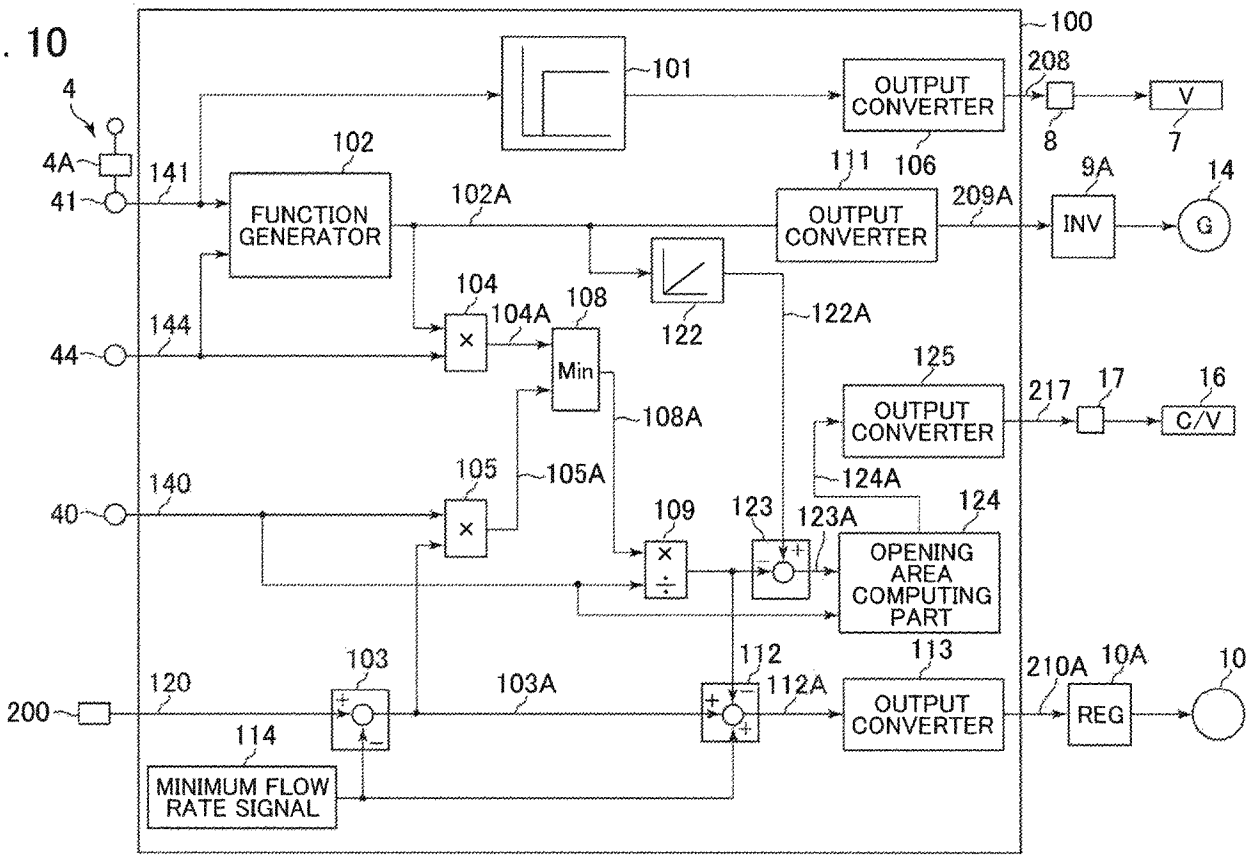
FIG. 10 is a block diagram of a controller constituting part of the hydraulic fluid energy regeneration device for a work machine, the hydraulic fluid energy regeneration device being practiced as the fourth embodiment.

Described below with reference to the accompanying drawings is a hydraulic fluid energy regeneration device for a work machine practiced as a fourth embodiment of the present invention. FIG. 9 is a schematic view of a drive control system constituting part of the hydraulic fluid energy regeneration device for a work machine, the hydraulic fluid energy regeneration device being practiced the fourth embodiment, and FIG. 10 is a block diagram of a controller constituting part of the hydraulic fluid energy regeneration device for a work machine, the hydraulic fluid energy regeneration device being practiced as the fourth embodiment. In FIGS. 9 and 10, the same reference characters as those in FIGS. 1 to 8 designate the same or corresponding parts, and their detailed explanations are omitted where redundant.

The hydraulic fluid energy regeneration device for a work machine shown in FIGS. 9 and 10 and practiced as the fourth embodiment of the invention is approximately made up of the same hydraulic power source and the same work implement, among others, as in the first embodiment, but has a different configuration. The difference is that in the fourth embodiment, the hydraulic fluid flow fed from the auxiliary hydraulic pump 15 to the hydraulic line 30 of the hydraulic pump 10 is controlled not by controlling the displacement of the auxiliary hydraulic pump 15 but by adjusting the opening area of a bleed valve 16 attached to a discharge hydraulic line 34 serving as a discharge circuit connected to the auxiliary hydraulic line 31. The difference thus involves the auxiliary hydraulic pump 15 being constituted as a fixed displacement hydraulic pump. Further, the controller 100 of the fourth embodiment differs from its counterpart of the first embodiment in that there are provided a fourth function generator 122, a fourth subtraction computing unit 123, an opening area computing part 124, and a seventh output converter 125.

In reference to FIG. 9, the parts different from those in the first embodiment are explained below.

A discharge hydraulic line 34 communicating with the tank 12 is connected between the auxiliary hydraulic pump 15 and the check valve 6 on the auxiliary hydraulic line 31. The bleed valve 16 attached to the discharge hydraulic line 34 controls the hydraulic fluid flow discharged from the auxiliary hydraulic line 31 to the tank 12.

A spring 16*b* is attached to one port of the bleed valve 16, and a pilot pressure receiving part 16*a* is attached to the other port of the bleed valve 16. The spool in the bleed valve 16 is moved in keeping with the pressure of the pilot hydraulic fluid input to the pilot pressure receiving part 16*a*. The opening area through which the hydraulic fluid flows is thus controlled. When the pressure of the pilot hydraulic fluid is at or higher than a predetermined value, the bleed valve 16 is completely shut off. This permits control of the hydraulic fluid flow discharged from the auxiliary hydraulic line 31 into the tank 12 via the discharge hydraulic line 34. The pilot pressure receiving part 16*a* is supplied with the pilot hydraulic fluid from the pilot hydraulic pump 11 via a solenoid proportional pressure reducing valve 17, to be discussed later.

The hydraulic fluid from the pilot hydraulic pump 11 is input to the input port of the solenoid proportional pressure reducing valve 17 in the fourth embodiment. Meanwhile, a command signal from the controller 100 is input to the operation part of the solenoid proportional pressure reducing valve 17. The spool positions of the solenoid proportional pressure reducing valve 17 are adjusted in keeping with that command signal. That in turn suitably adjusts the pressure of the pilot hydraulic fluid fed from the pilot hydraulic pump 11 to the pilot pressure receiving part 16*a* of the bleed valve 16.

The controller 100 outputs a control command to the solenoid proportional pressure reducing valve 17 in a manner allowing the difference between the delivery flow from the auxiliary hydraulic pump 15 and the target assist flow to flow into the tank 12 via the bleed valve 16 so that the target assist flow rate computed internally by the controller will be attained. Given the control command, the solenoid proportional pressure reducing valve 17 adjusts the opening area of the bleed valve 16 accordingly.

Outlined below is the operation of the above-described fourth embodiment of the present invention in the form of the hydraulic fluid energy regeneration device for a work machine. What takes place when the control lever of the operating device 4 is operated in the boom lowering direction in such a manner as not to exceed a prescribed value is the same as in the first embodiment and thus will not be discussed further.

When the operator operates the control lever of the operating device 4 in the boom lowering direction in a manner equal to or exceeding the prescribed value, the controller 100 outputs a switching command to the solenoid selector valve 8, a revolution speed command to the inverter 9A, a control command to the solenoid proportional valve 17 controlling the bleed valve 16, and a displacement command to the regulator 10A of the hydraulic pump 10.

As a result, the selector valve 7 is switched to the interrupting position. With the hydraulic line to the control valve 5 thus interrupted, the return hydraulic fluid from the bottom-side oil chamber 3*a*1 in the boom cylinder 3*a* flows to the regeneration circuit 33 to drive the hydraulic motor 13, before being discharged to the tank 12.

The drive power of the hydraulic motor 13 rotates the auxiliary hydraulic pump 15. The hydraulic fluid delivered by the auxiliary hydraulic pump 15 flows through the auxiliary hydraulic line 31 and the check valve 6 to join the hydraulic fluid delivered by the hydraulic pump 10, thereby assisting the hydraulic pump 10 with power.

The controller 100 outputs a control command to the solenoid proportional pressure reducing valve 17 to control the opening area of the bleed valve 16, thus adjusting the hydraulic fluid flow coming from the auxiliary hydraulic pump 15 to join to the hydraulic fluid delivered by the hydraulic pump 10. This controls the joint hydraulic fluid flow to the hydraulic pump 10 at a desired flow rate. The controller 100 also outputs a displacement command to the regulator 10A in such a manner as to reduce the displacement of the hydraulic pump 10 by as much as the hydraulic fluid flow supplied from the auxiliary hydraulic pump 15.

Of the hydraulic energy input to the hydraulic motor 13, the excess energy not consumed by the auxiliary hydraulic pump 15 is used to drive the electric motor 14 to generate power. The electric energy generated by the electric motor 14 is stored into the electrical storage device 9C.

In the fourth embodiment, the energy of the hydraulic fluid discharged from the boom cylinder 3*a* is recovered by the hydraulic motor 13. The recovered energy is used as the drive power of the auxiliary hydraulic pump 15 to assist the hydraulic pump 10 with power. Any excess power is stored into the electrical storage device 9C via the electric motor 14. In this manner, energy is efficiently utilized and fuel economy is improved. Furthermore, the auxiliary hydraulic pump 15 need only be a fixed displacement hydraulic pump, because the joint hydraulic fluid flow is regulated by adjusting the opening area of the bleed valve 16. As a result, the power regeneration device 70 is simply configured.

Outlined below using FIG. 10 is the control of the controller 100 in the fourth embodiment. In reference to FIG. 10, the parts different from those in the first embodiment are explained below.

In the first embodiment, the target displacement signal 110A obtained by dividing the target assist flow rate signal 109A by the final target bottom flow rate signal 102A is output by the third output converter 111 to the regulator 15A. In the fourth embodiment, by contrast, a target opening area signal 124A from the opening area computing part 124 is output to the seventh output converter 125. The seventh output converter 125 converts the input target opening area signal 124A into a control command for the solenoid proportional pressure reducing valve 17, and outputs the control command to the solenoid proportional pressure reducing valve 17 as a solenoid valve command 217. This controls the opening of the bleed valve 16, thereby controlling the flow discharged by the auxiliary hydraulic pump 15 to the tank 12. As a result, the joint flow of the hydraulic fluid delivered by the auxiliary hydraulic pump 15 and flowing to the hydraulic pump 10 is controlled at a desired flow rate.

The controller 100 in the fourth embodiment is characterized in that the second division computing unit 110 and the third output converter 111 of the first embodiment are omitted and that the remaining computing units are supplemented with the fourth function generator 122, fourth subtraction computing unit 123, opening area computing part 124, and seventh output converter 125.

As shown in FIG. 10, the final target bottom flow rate signal 102A computed by the second function generator 102 is input to the fourth function generator 122. On the basis of the final target bottom flow rate signal 102A, the fourth function generator 122 calculates a delivery flow rate signal 122A for the auxiliary hydraulic pump 15. The delivery flow rate signal 122A is output to the fourth subtraction computing unit 123.

The delivery flow rate signal 122A for the auxiliary hydraulic pump 15 coming from the fourth function generator 122 and the target assist flow rate signal 109A from the first division computing unit 109 are input to the fourth subtraction computing unit 123. The fourth subtraction computing unit 123 calculates the difference between the two inputs as a target bleed flow rate signal 123A, and outputs the target bleed flow rate signal 123A to one input port of the opening area computing part 123.

The target bleed flow rate signal 123A from the fourth subtraction computing unit 123 is input to one port of the opening area computing part 124, and the delivery pressure of the hydraulic pump 10 detected by the pressure sensor 40 is input to the other port of the opening area computing part 124 as the pressure signal 140. The opening area computing part 124 calculates the target opening area of the bleed valve 16 using the orifice formula on the basis of these input signals. The opening area computing part 124 proceeds to output the target opening area signal 124A to the seventh output converter 125.

Here, the target opening area $A_0$ of the bleed valve 16 is calculated using the equation (3) below.

$$A_0 = Q_0 / C\sqrt{P_p} \tag{3}$$

where, $Q_0$ stands for the target bleed flow rate, $P_p$ for the hydraulic pump pressure, and C for a flow rate coefficient.

The seventh output converter 125 converts the input target opening area signal 124A into a control command for the solenoid proportional pressure reducing valve 17, and outputs the control command as the solenoid valve command 217 to the solenoid proportional pressure reducing valve 17. This controls the opening of the bleed valve 16, thereby controlling the flow from the auxiliary hydraulic pump 15 that is discharged to the tank 12.

Explained below using FIGS. 9 and 10 is the operation of the control logic governing the above-described fourth embodiment of the present invention in the form of the hydraulic fluid energy regeneration device for a work machine. The computing units added to the first embodiment to make up the fourth embodiment are described in particular.

In the controller 100, the final target bottom flow rate signal 102A calculated by the second function generator 102 is input to the fourth function generator 122. The fourth function generator 122 calculates the delivery flow rate signal 122A for the auxiliary hydraulic motor 15.

The delivery flow rate signal 122A calculated by the fourth function generator 122 and the target assist flow rate signal 109A calculated by the first division computing unit 109 are input to the fourth subtraction computing unit 123. The fourth subtraction computing unit 123 calculates the target bleed flow rate signal 123A. The target bleed flow rate signal 123A is input to the opening area computing part 124.

The opening area computing part 124 calculates the target opening area signal 124A for the bleed valve 16 on the basis of the input target bleed flow rate signal 123A and the pressure signal 140 from the hydraulic pump 10. The opening area computing part 124 outputs the target opening area signal 124A to the seventh output converter 125.

The seventh output converter 125 outputs a control command to the solenoid proportional pressure reducing valve 17 in a manner causing the bleed valve 16 to attain the calculated opening area. This allows an excess flow of the hydraulic fluid delivered by the auxiliary hydraulic pump 15 to be discharged to the tank 12 via the bleed valve 16. As a result, the joint flow of the hydraulic fluid from the hydraulic pump 10 and the hydraulic fluid from the auxiliary hydraulic pump 15 is adjusted to a desired flow rate.

The above-described fourth embodiment of the present invention in the form of the hydraulic fluid energy regeneration device for a work machine provides the same advantageous effects as those of the first embodiment.

Also according to the above-described fourth embodiment of the present invention, the opening area of the bleed valve 16 is adjusted to regulate the hydraulic fluid flow from the auxiliary hydraulic plump 15 that assists the hydraulic pump 10 with power. This simplifies the configuration of the power regeneration device 70, reduces production costs, and improves maintainability.

The present invention is not limited to the above-descried embodiments and may be implemented in diverse variations. For instance, the embodiments above have been described in detail to offer easy-to-understand explanations of the invention. The present invention is not necessarily limited to an entity containing all the structures explained above.

DESCRIPTION OF REFERENCE CHARACTERS

1: Hydraulic excavator
1*a*: Boom
3*a*: Boom cylinder
3*a*1: Bottom-side oil chamber
3*a*2: Rod-side oil chamber
4: Operating device
4A: Pilot valve
5: Control valve
6: Check valve
7: Selector valve
8: Solenoid selector valve
9A: Inverter
9B: Chopper

9C: Electrical storage device
10: Hydraulic pump
10A: Regulator
11: Pilot hydraulic pump
12: Tank
13: Hydraulic motor
14: Electric motor
15: Auxiliary hydraulic pump
15A: Regulator
16: Bleed valve
17: Solenoid proportion pressure reducing valve
24: Operating device
24A: Pilot valve
25: Chopper
30 Hydraulic line
31: Auxiliary hydraulic line
32: Bottom-side hydraulic line
33: Regeneration circuit
34: Discharge hydraulic line
40: Pressure sensor (hydraulic pump delivery pressure detecting means)
41: Pressure sensor (boom lowering operation amount detecting means)
42: Pressure sensor
43: Pressure sensor
44: Pressure sensor (bottom-side oil chamber pressure detecting means)
50: Engine
60: Solenoid proportional pressure reducing valve
61: Control valve
62: Variable displacement hydraulic motor
62A: Regulator
70: Power regeneration device
100: Controller (control unit)
200: Vehicle body controller

The invention claimed is:

1. A hydraulic fluid energy regeneration device for a work machine, comprising:

a first hydraulic actuator;

a regeneration hydraulic motor driven by return hydraulic fluid discharged by the first hydraulic actuator;

a first hydraulic pump mechanically connected to the regeneration hydraulic motor;

a second hydraulic pump that delivers a hydraulic fluid for driving the first hydraulic actuator and/or a second hydraulic actuator;

a junction line that allows a hydraulic fluid delivered by the first hydraulic pump to join a hydraulic fluid delivered by the second hydraulic pump;

a first regulator that regulates a flow rate of the hydraulic fluid coming from the first hydraulic pump and flowing through the junction line;

a second regulator that regulates a delivery flow rate of the second hydraulic pump; and a control unit to which an estimated pump flow rate signal for the second hydraulic pump is input, the control unit calculating the flow rate of the hydraulic fluid delivered by the first hydraulic pump and the flow rate of the hydraulic fluid delivered by the second hydraulic pump in accordance with the estimated pump flow rate signal, the control unit further outputting a control command to the first regulator and a control command to the second regulator in accordance with the calculated flow rates, wherein the control unit includes:

a first computing part that calculates a demanded pump flow rate in accordance with the input estimated pump flow rate signal for the second hydraulic pump, the first computing part further outputting a control command to the first regulator in such a manner that the flow rate of the hydraulic fluid coming from the first hydraulic pump and flowing through the junction line equals to or lower than the demanded pump flow rate; and a second computing part that subtracts from the demanded pump flow rate the flow rate of the hydraulic fluid coming from the first hydraulic pump and flowing through the junction line to obtain a target pump flow rate, the second computing part further outputting a control command to the second regulator in such a manner that the calculated target pump flow rate is attained.

2. The hydraulic fluid energy regeneration device for a work machine according to claim 1, further comprising:

an electric motor mechanically connected to the first hydraulic pump and to the regeneration hydraulic motor;

a third regulator that regulates the revolution speed of the electric motor;

an operating device for operating the first hydraulic actuator; and an operation amount detector that detects an operation amount of the operating device, wherein the control unit includes a third computing part that is configured to:

receive the operation amount of the operating device detected by the operation amount detector;

calculate, in accordance with the operation amount, recovered power to be input to the regeneration hydraulic motor from the return hydraulic fluid discharged by the first hydraulic actuator;

calculate demanded assist power necessary for supplying the hydraulic fluid flow from the first hydraulic pump through the junction line;

set target assist power in such a manner that the recovered power and the demanded assist power are not exceeded; and output control commands to the second regulator and the third regulator in such a manner that the target assist power is attained.

3. The hydraulic fluid energy regeneration device for a work machine according to claim 1, further comprising:

a bottom-side hydraulic line that branches from a branch part attached to a line connecting the first hydraulic actuator with the regeneration hydraulic motor, the bottom-side hydraulic line discharging the return hydraulic fluid from the first hydraulic actuator to a tank;

a selector valve attached to the bottom-side hydraulic line, the selector valve switching between communication and interruption of the bottom-side hydraulic line;

an operating device for operating the first hydraulic actuator; and an operation amount detector that detects an operation amount of the operating device, wherein the control unit includes a fourth computing part that receives the operation amount of the operating device detected by the operation amount detector, the fourth computing part outputting an interruption command to the selector valve in accordance with the operation amount.

4. The hydraulic fluid energy regeneration device for a work machine according to claim 2, further comprising:

a bottom-side hydraulic line that branches from a branch part attached to a line connecting the first hydraulic actuator with the regeneration hydraulic motor, the bottom-side hydraulic line discharging the return hydraulic fluid from the first hydraulic actuator to a tank; and a control valve attached to the bottom-side hydraulic line, the control valve regulating the flow rate of the bottom-side hydraulic line, wherein the control unit includes a fifth computing part that outputs a control command to the control valve in such a manner as to let the power discharged by the first hydraulic actuator branch to the bottom-side hydraulic line such that the recovered power does not exceed maximum power of the electric motor.

5. The hydraulic fluid energy regeneration device for a work machine according to claim 2, further comprising:

a bottom-side hydraulic line that branches from a branch part attached to a line connecting the first hydraulic actuator with the regeneration hydraulic motor, the bottom-side hydraulic line discharging the return hydraulic fluid from the first hydraulic actuator to a tank; and a control valve attached to the bottom-side hydraulic line, the control valve regulating the flow rate of the bottom-side hydraulic line, wherein the control unit includes a sixth computing part that outputs a control command to the control valve in such a manner as to let the power discharged by the first hydraulic actuator branch to the bottom-side hydraulic line such that the recovered power does not exceed the sum of maximum power of the electric motor and the demanded assist power.

6. The hydraulic fluid energy regeneration device for a work machine according to claim 2, further comprising:

a bottom-side hydraulic line that branches from a branch part attached to a line connecting the first hydraulic actuator with the regeneration hydraulic motor, the bottom-side hydraulic line discharging the return hydraulic fluid from the first hydraulic actuator to a tank; and a control valve attached to the bottom-side hydraulic line, the control valve regulating the flow rate of the bottom-side hydraulic line;

wherein the control unit includes a seventh computing part that outputs a control command to the control valve in such a manner as to let the power discharged by the first hydraulic actuator branch to the bottom-side hydraulic line such that a maximum hydraulic fluid flow allowed to be input to the regeneration hydraulic motor is not exceeded.

7. The hydraulic fluid energy regeneration device for a work machine according to claim 1, further comprising:

a discharge line that branches from the junction line and communicates with a tank; and a bleed valve attached to the discharge line, the bleed valve bleeding part or all of the hydraulic fluid from the first hydraulic pump off into a tank, wherein the first regulator is a solenoid proportional valve regulating the opening area of the bleed valve.

8. The hydraulic fluid energy regeneration device for a work machine according to claim 1, wherein the first hydraulic pump is a variable displacement hydraulic pump, and wherein the control unit controls the displacement of the variable displacement hydraulic pump.

9. The hydraulic fluid energy regeneration device for a work machine according to claim 1, wherein the second hydraulic pump is a variable displacement hydraulic pump, and wherein the control unit controls the displacement of the variable displacement hydraulic pump.

* * * * *